US005607288A

United States Patent [19]

Wallis et al.

[11] Patent Number: 5,607,288

[45] **Date of Patent: *Mar. 4, 1997**

[54] SCROLL MACHINE WITH REVERSE ROTATION PROTECTION

[75] Inventors: Frank S. Wallis, Sidney; Jean-Luc Caillat, Dayton; Francis M. Simpson; Gary J. Anderson, both of Sidney; Donald W. Rode, St. Paris; Norman G. Beck, Sidney, all of Ohio

[73] Assignee: Copeland Corporation, Sidney, Ohio

[ * ] Notice: The term of this patent shall not extend beyond the expiration date of Pat. No. 5,591,014.

[21] Appl. No.: 237,756

[22] Filed: May 4, 1994

Related U.S. Application Data

[63] Continuation-in-part of Ser. No. 158,754, Nov. 29, 1993.

[51] Int. Cl.[6] ..... F04B 49/00; F01C 1/04

[52] U.S. Cl. ..... 417/310; 417/434; 417/505; 418/55.5; 418/180

[58] Field of Search ..... 418/55.1, 55.5, 418/180; 417/310, 434, 505

[56] References Cited

U.S. PATENT DOCUMENTS

| | | | |
|---|---|---|---|
| 4,596,520 | 6/1986 | Arata et al. . | |
| 4,840,545 | 6/1989 | Moilanen | 418/180 |
| 4,877,382 | 10/1989 | Caillat et al. . | |
| 4,968,232 | 11/1990 | Kikuchi . | |
| 5,074,761 | 12/1991 | Hirooka et al. . | |
| 5,102,316 | 4/1992 | Caillat et al. . | |
| 5,156,539 | 10/1992 | Anderson et al. . | |
| 5,167,491 | 12/1992 | Keller, Jr. et al. | 417/292 |
| 5,169,294 | 12/1992 | Barito . | |
| 5,240,389 | 8/1993 | Oikawa et al. . | |
| 5,336,058 | 8/1994 | Yokoyama | 417/299 |

*Primary Examiner*—Charles G. Freay
*Attorney, Agent, or Firm*—Harness, Dickey & Pierce, P.L.C.

[57] ABSTRACT

A scroll machine has an intermediate pressure cavity which is operable to open and close a leakage path between the discharge zone and the suction zone of the scroll machine. The leakage path is closed when intermediate pressurized fluid is supplied to the cavity and the leakage path is open when the cavity is open to the suction zone of the compressor. A valve which can be mechanical or electrical is used to open and close a passageway extending between the cavity and the suction zone of the machine. Biasing means is located within the scroll machine in order to control the rate at which the intermediate pressurized fluid is bled to the suction zone of the compressor.

18 Claims, 12 Drawing Sheets

14
220
86
104
84
142
228
226
224
222
52
24
28
32
50
20
30
26
230

SCROLL MACHINE WITH REVERSE ROTATION PROTECTION

CROSS REFERENCE TO RELATED APPLICATION

This application is a Continuation-In-Part of U.S. application Ser. No. 8/158,754, filed Nov. 29, 1993,

FIELD OF THE INVENTION

The present invention relates generally to scroll machines, and more particularly to the elimination of reverse rotation problems in scroll machines such as those used to compress refrigerant in refrigerating, air-conditioning and heat pump systems.

BACKGROUND AND SUMMARY OF THE INVENTION

Scroll machines are becoming more and more popular for use as compressors in both refrigeration as well as air conditioning and heat pump applications due primarily to their capability for extremely efficient operation. Generally, these machines incorporate a pair of intermeshed spiral wraps, one of which is caused to orbit relative to the other so as to define one or more moving chambers which progressively decrease in size as they travel from an outer suction port towards a center discharge port. An electric motor is normally provided which operates to drive the orbiting scroll member via a suitable drive shaft.

Because scroll compressors depend upon a seal created between opposed flank surfaces of the wraps to define successive chambers for compression, suction and discharge valves are generally not required. However, when such compressors are shut down, either intentionally as a result of the demand being satisfied, or unintentionally as a result of a power interruption, there is a strong tendency for the pressurized chambers and/or backflow of compressed gas from the discharge chamber to effect a reverse orbital movement of the orbiting scroll member and the associated drive shaft. This reverse movement often generates noise or rumble which may be considered objectionable and undesirable. Further, in machines employing a single phase drive motor, it is possible for the compressor to begin running in the reverse direction should a momentary power failure be experienced. This reverse operation may result in overheating of the compressor and/or other damage to the apparatus. Additionally, in some situations, such as a blocked condenser fan, it is possible for the discharge pressure to increase sufficiently to stall the drive motor and effect a reverse rotation thereof. As the orbiting scroll orbits in the reverse direction, the discharge pressure will decrease to a point where the motor again is able to overcome this pressure head and orbit the scroll member in the forward direction. However, the discharge pressure will again increase to a point where the drive motor is stalled and the cycle is repeated. Such cycling is undesirable in that it results in excessive stresses on various components within the compressor. These components must then be increased in size or complexity in order to withstand the excessive stresses caused by this undesirable cycling.

A primary object of the present invention resides, in one embodiment, in the provision of a very simple and unique solenoid valve which can be easily assembled into a conventional gas compressor of the scroll type without significant modification of the overall compressor design, and which functions at compressor shut-down to allow gas flow from an area of intermediate pressure to an area of suction pressure. With intermediate pressure and suction pressure equalized, a leak is created from the discharge side of the compressor to the suction side of the compressor. This leak will balance the discharge gas with the suction gas thereby preventing discharge gas from driving the compressor in the reverse direction which in turn eliminates the normal shut-down noise associated with such reverse rotation.

Another object of the present invention resides, in an alternate embodiment, in the provision of a very simple and unique mechanically operated valve which can also be easily assembled into a conventional scroll compressor without significant modification of the overall compressor design, and which also functions at compressor shut-down to allow gas flow from an area of intermediate pressure to an area of suction pressure. With intermediate pressure and suction pressure equalized, a leak is created from the discharge side of the compressor to the suction side of the compressor. This leak will balance the discharge gas with the suction gas, thereby preventing reverse rotation and the attendant shut-down noise associated therewith.

Both of the primary embodiments of the present invention achieve the desired results utilizing a very simple valve which is positioned between an area of intermediate pressure and an area of suction pressure. In the first set of embodiments, the valve is actuated by a solenoid and in the second set of embodiments, the valve is actuated by a mechanical device. Additional embodiments are disclosed which also facilitate starting of the compressor which is especially applicable to compressors having low-starting-torque motors.

These and other features of the present invention will become apparent from the following description and the appended claims, taken in conjunction with the accompanying drawings.

BRIEF DESCRIPTION OF THE DRAWINGS

In the drawings which illustrate the best mode presently contemplated for carrying out the present invention.

DESCRIPTION OF THE PREFERRED EMBODIMENTS

Figure 1:
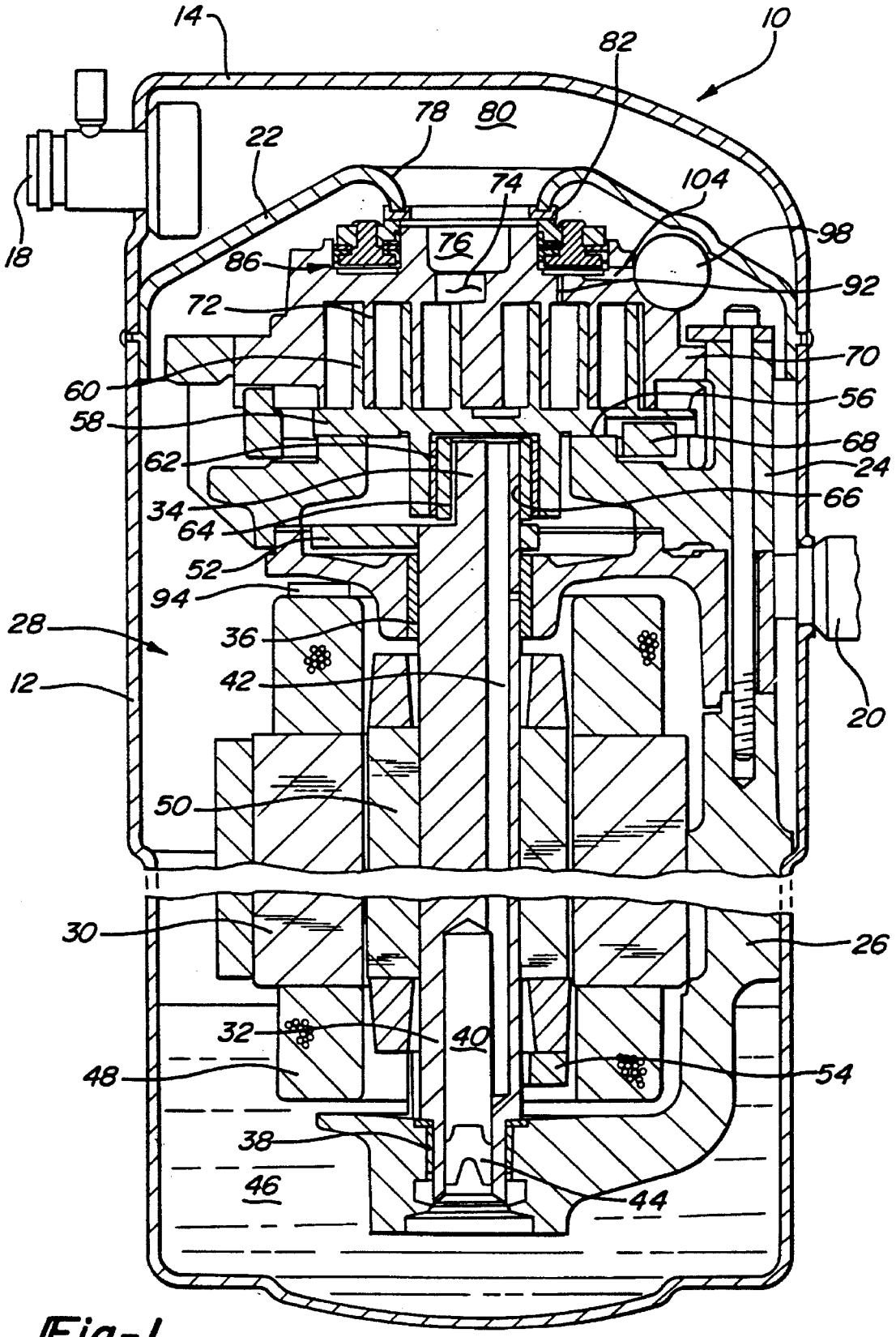
FIG. 1 is a vertical sectional view through the center of a scroll compressor which incorporates a first embodiment of the present invention.

While the present invention is suitable for incorporation in many different types of scroll machines, for exemplary purposes it will be described herein incorporated in a scroll refrigerant compressor of the general structure illustrated in FIG. 1. Referring now the drawings and in particular to FIG. 1, a compressor 10 is shown which comprises a generally cylindrical hermetic shell 12 having welded at the upper end thereof a cap 14. Cap 14 is provided with a refrigerant discharge fitting 18 which may have the usual discharge valve therein (not shown). Other major elements affixed to the shell include an inlet fitting 20, a transversely extending partition 22 which is welded about its periphery at the same point that cap 14 is welded to shell 12, a two piece main bearing housing 24 and a lower bearing housing 26 having a plurality of radially outwardly extending legs each of which is suitably secured to shell 12. Lower bearing housing 26 locates and supports within shell 12 two piece main bearing housing 24 and a motor 28 which includes a motor stator 30. A drive shaft or crankshaft 32 having an eccentric crank pin 34 at the upper end thereof is rotatably journaled in a bearing 36 in main bearing housing 24 and a second bearing 38 in lower bearing housing 26. Crankshaft 32 has at the lower end a relatively large diameter concentric bore 40 which communicates with a radially outwardly inclined smaller diameter bore 42 extending upwardly therefrom to the top of crankshaft 32. Disposed within bore 40 is a stirrer 44. The lower portion of the interior shell 12 defines an oil sump 46 which is filled with lubricating oil. Bore 40 acts as a pump to pump lubricating fluid up the crankshaft 32 and into bore 42 and ultimately to all of the various portions of the compressor which require lubrication.

Crankshaft 32 is rotatively driven by electric motor 28 including motor stator 30, windings 48 passing therethrough and a motor rotor 50 press fitted on crankshaft 32 and having upper and lower counterweights 52 and 54, respectively.

The upper surface of two piece main bearing housing 24 is provided with a flat thrust bearing surface 56 on which is disposed an orbiting scroll 58 having the usual spiral vane or wrap 60 on the upper surface thereof. Projecting downwardly from the lower surface of orbiting scroll 58 is a cylindrical hub having a journal bearing 62 therein and in which is rotatively disposed a drive bushing 64 having an inner bore 66 in which crank pin 34 is drivingly disposed. Crank pin 34 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference. An Oldham coupling 68 is also provided positioned between orbiting scroll 58 and bearing housing 24. Oldham coupling 68 is keyed to orbiting scroll 58 and a non-orbiting scroll 70 to prevent rotational movement of orbiting scroll member 58. Oldham coupling 68 is preferably of the type disclosed in assignee's copending application Ser. No. 591,443, entitled "Oldham Coupling For Scroll Compressor" filed Oct. 1, 1990, the disclosure of which is hereby incorporated herein by reference.

Non-orbiting scroll member 70 is also provided having a wrap 72 positioned in meshing engagement with wrap 60 of orbiting scroll 58. Non-orbiting scroll 70 has a centrally disposed discharge passage 74 which communicates with an upwardly open recess 76 which in turn is in fluid communication via an opening 78 in partition 22 with a discharge muffler chamber 80 defined by cap 14 and partition 22. The entrance to opening 78 has an annular seat portion 82 therearound. Non-orbiting scroll member 70 has in the upper surface thereof an annular recess 84 having parallel coaxial sidewalls in which is sealingly disposed for relative axial movement an annular floating seal 86 which serves to isolate the bottom of recess 84 from the presence of gas under suction pressure at 90 and discharge pressure at 88 so that it can be placed in fluid communication with a source of intermediate fluid pressure by means of a passageway 92. Non-orbiting scroll member 70 is thus axially biased against orbiting scroll member 58 to enhance wrap tip sealing by the forces created by discharge pressure acting on the central portion of scroll member 70 and those created by intermediate fluid pressure acting on the bottom of recess 84. Discharge gas in recess 76 and opening 78 is also sealed from gas at suction pressure in the shell by means of seal 86 acting against seat portion 82. This axial pressure biasing and the functioning of floating seal 86 are disclosed in greater detail in applicant's assignee's U.S. Pat. No. 5,156,539, the disclosure of which is hereby incorporated herein by reference. Non-orbiting scroll member 70 is designed to be mounted to bearing housing 24 in a suitable manner which will provide limited axial (and no rotational) movement of non-orbiting scroll member 70. Non-orbiting scroll member 70 may be mounted in the manner disclosed in the aforementioned U.S. Pat. No. 4,877,382 or U.S. Pat. No. 5,102,316, the disclosure of which is hereby incorporated herein by reference.

The compressor is preferably of the "low side" type in which suction gas entering via fitting 20 is allowed, in part, to escape into the shell and assist in cooling the motor. So long as there is an adequate flow of returning suction gas the motor will remain within desired temperature limits, When this flow ceases, however, the loss of cooling will cause a motor protector 94 to trip and shut the machine down.

The scroll compressor as thus far broadly described is either now known in the art or is the subject of other pending applications for patent or patents of applicant's assignee.

As noted, both of the primary embodiments of the present invention utilize a very simple valve which functions at compressor shut down to allow gas flow from an area of intermediate pressure to an area of suction pressure. The valve of the present invention operates to allow gas at intermediate pressure to flow to an area of suction pressure which then allows discharge pressure to dump to suction pressure. By working with gas at intermediate pressure rather than directly with gas at discharge temperature, the size, complexity and cost of the valve can be significantly reduced. In the first set of embodiments, the valve is operated by a solenoid, and in the second set of embodiments, the valve is run by a mechanical device. It is believed that all primary embodiments of the present invention are fully applicable to any type of scroll compressor.

Figure 2:
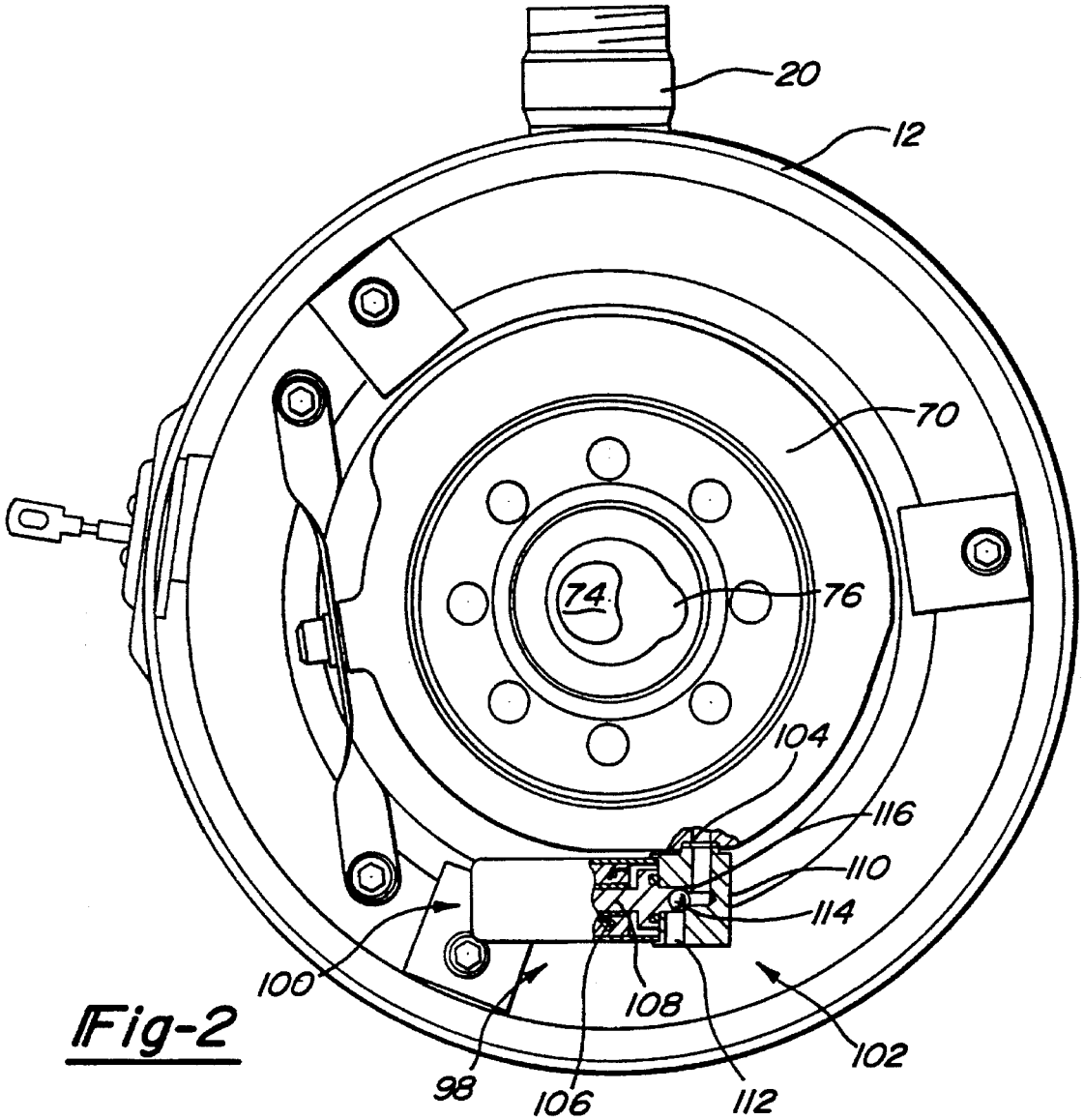
FIG. 2 is a top elevational view of the compressor shown in FIG. 1 with the cap and partition removed.
Figure 3:
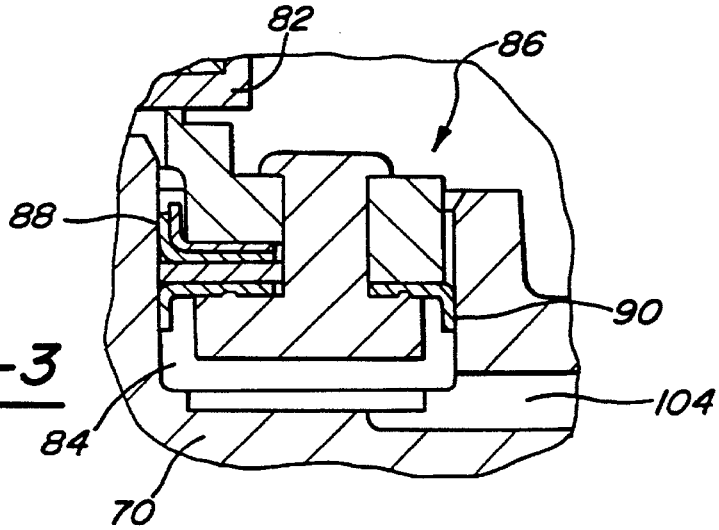
FIG. 3 is a fragmentary enlarged view of a portion of the floating seal illustrated in FIG. 1.

The first embodiment of the present invention is shown in FIGS. 1 through 3. The first embodiment makes use of the dual pressure balancing scheme described above which is used to axially balance non-orbiting scroll member 70 with floating seal 86 being used to separate the discharge gas pressure from the suction gas pressure.

A solenoid valve 98 comprises a solenoid 100 and a valve 102. Solenoid valve 98 can be wired in parallel or in series with motor 28 such that solenoid 100 is activated and deactivated with motor 28 or solenoid valve 98 may be wired independently from motor 28. When solenoid valve 98 is wired independently from motor 28, valve 98 may be operated in a pulsed manner or a pulsed width modulated manner to modulate the capacity of compressor 10. Solenoid 100 is operable to open and close valve 102 which is in communication with a passageway 104 located within non-orbiting scroll 70. Passageway 104 extends from the bottom of recess 84 which is at intermediate pressure during operation of the compressor to the area of the compressor which contains suction gas at suction gas pressure.

Solenoid 100 and valve 102 are best shown in FIG. 2. Solenoid 100 includes a cylindrical wire coil 106 surrounding a plunger 108 in the usual manner. Solenoid 100 is secured to valve 102 by any method known well in the art. Valve 102 includes a valve body 110 having a passageway 112 which is in communication with passageway 104 in non-orbiting scroll 70. Valve body 112 is attached to non-orbiting scroll 70 by methods known well in the art. A ball 114 is disposed within passageway 112 and moveable between an open position and a closed position due to the movement of plunger 108. In its open position, fluid is allowed to flow from passageway 104 through passageway 112. In its closed position fluid is prohibited from flowing through passageways 104 and 112 due to ball 114 being forced against a valve seat 116 located within passageway 112 by plunger 108.

At compressor start-up, solenoid 100 is energized and valve 102 is closed to block any fluid flow through passageway 104. In this manner, compressor 10 makes a normal start-up. In some designs of compressors, compression within the scrolls builds rapidly at start-up. This build up of pressure can be so rapid in fact that the compressor may stall because of insufficient motor torque. Generally, this is only a problem when using single phase motors. When this build up of pressure occurs, the motor stalls and the motor protector repeatedly trips and the compressor has a difficult time starting again. An option in the present invention is to build in a time delay to the activation of solenoid 100 to prevent the closing of passageway 104 at start-up, thus keeping intermediate pressure from building up. This lack of intermediate pressure will allow the scrolls to separate axially and prevent compression build-up until sufficient motor torque has been generated.

At compressor shut-down, solenoid 100 is de-energized at the same instant that power to motor 28 is cut off. The de-energization of solenoid 100 causes valve 102 to open and allows fluid flow through passageways 104 and 112 from the bottom of recess 84 to the suction area of compressor 10. As the intermediate pressure and suction pressure become equalized, floating seal 86 has a net downward force due to the discharge gas pressure and floating seal 86 moves downward in recess 84 and creates a discharge gas to suction gas leak across the top of floating seal 86 at annular seat portion 82. By controlling the size of passageway 104 and/or passageway 112, reverse rotation can be minimized to any acceptable reverse RPM or it can be completely eliminated.

Solenoid valve 98 may be an AC (alternating current) or a DC (direct current) solenoid independent of the type of motor 28. If a DC solenoid is to be used with an AC motor, a rectifier needs to be wired between the AC power source and the DC solenoid.

Figure 4:
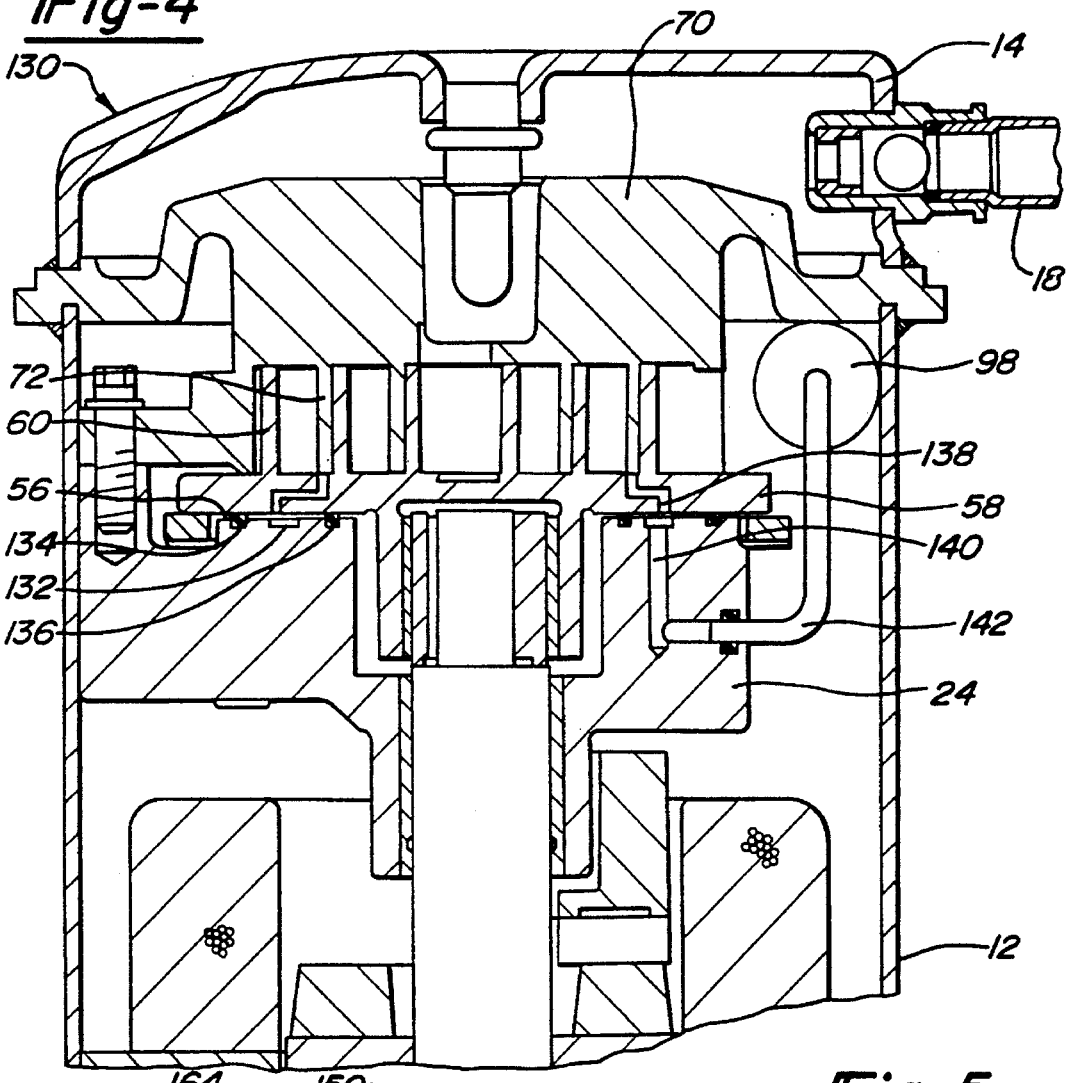
FIG. 4 is a vertical section through the upper portion of a scroll compressor which incorporates another embodiment of the present invention.

FIG. 4 shows another embodiment of the present invention. In FIG. 4, elements which are the same as those in FIGS. 1 through 3 have been given the same reference numerals. The embodiment in FIGS. 1 through 3 purges intermediate pressure within recess 84 which holds non-orbiting scroll 70 down allowing floating seal 86 to drop. The embodiment shown in FIG. 4 is incorporated into a compressor which uses intermediate pressure to bias orbiting scroll 58 upward. The embodiment shown in FIG. 4 purges the intermediate pressure holding orbiting scroll 58 up which then creates sufficient tip clearance between the tips of scroll wraps 60 and 72 and their respective mating scroll to allow high pressure discharge gas to leak back through scrolls 58 and 70 before excessive reversals occur.

FIG. 4 shows the upper section of a compressor 130. Compressor 130 is similar to compressor 10 with the exception that partition 22 of compressor 10 has been eliminated along with floating seal 86. In order to separate the discharge gas from the suction gas area, non-orbiting, or in this case, stationary, scroll 70 extends completely across shell 12 and cap 14. Both shell 12 and cap 14 are secured to non-orbiting scroll 70 by welding or other means known well in the art.

Main bearing housing 24 is provided with an annular chamber 132 extending into flat thrust bearing surface 56. A first annular seal 134 is positioned radially outward from chamber 132 and a second annular seal 136 is positioned radially inward from chamber 132. Seals 134 and 136 operate to prohibit fluid flow from chamber 132 to the suction side of compressor 130. A passageway 138 extends through orbiting scroll 58 and fluidically connects chamber 132 to an area of intermediate pressure within compressor 130. During operation of compressor 130, fluid at an intermediate pressure is supplied to chamber 132 through passageway 138. Orbiting scroll 58 is thus forced axially upward due to the fluid pressure within chamber 132. The fluid pressure within chamber 32 is maintained by seals 134 and 136.

Compressor 130 further includes a passageway 140 extending through main bearing housing 24 and connecting chamber 132 to solenoid valve 98. The embodiment shown in FIG. 4 includes a fluid tube 142 extending from passageway 140 to solenoid valve 98 which will allow the placement of solenoid valve 98 anywhere within the suction area of compressor 130 as space will permit. It will be appreciated that the use of tube 142 or its equivalent may be used with any of the embodiments of the present invention to facilitate packaging and design requirements. It is also possible to have tube 142 extend through shell 12 and have solenoid 100 and valve 102 located externally to shell 12 if desired.

The operation of the embodiment shown in FIG. 4 is similar to the operation of the embodiment shown in FIGS. 1 through 3. At compressor start-up, solenoid 100 is energized and valve 102 is closed to block any fluid flow from passageway 140 through passageway 112. In this way compressor 130 makes a normal start-up. The time delay feature at compressor start-up described above may also be built into solenoid valve 98 for this embodiment. At compressor shut-down, solenoid 100 is de-energized causing valve 102 to open and allow fluid flow through passageways 140 and 112 from chamber 132 to the suction area of compressor 130. As the intermediate pressure and suction pressure are equalized, orbiting scroll 58 moves downward and creates a discharge gas to suction gas leak across the tips of scroll wraps 60 and 72. The amount of reverse rotation can be controlled by controlling the size of passageway 140 and/or passageway 112. The de-energization of valve 102 and the shut-down of motor 28 may also be tied in with a time delay to insure that sufficient leakage between chamber 132 and the suction area of the compressor has occurred before the motor is shut down. It is to be appreciated that this time delay feature at the shut down of the compressor can be applied to any of the embodiments of the present invention which incorporate solenoid valve 98.

Figure 5:
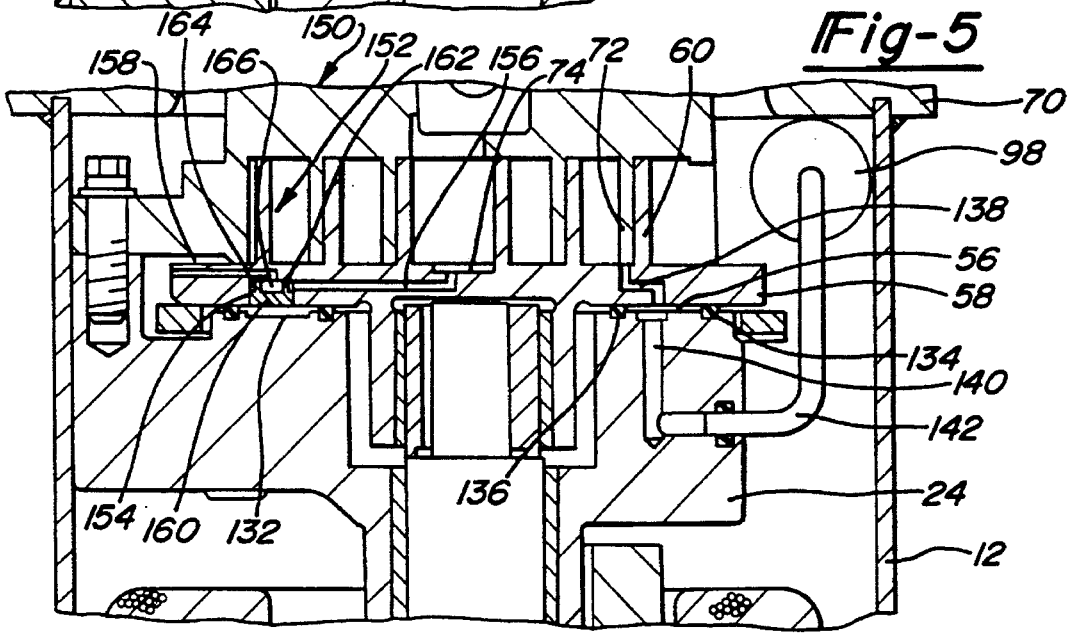
FIG. 5 is a vertical section through the upper portion of a scroll compressor which incorporates another embodiment of the present invention.
Figure 6:
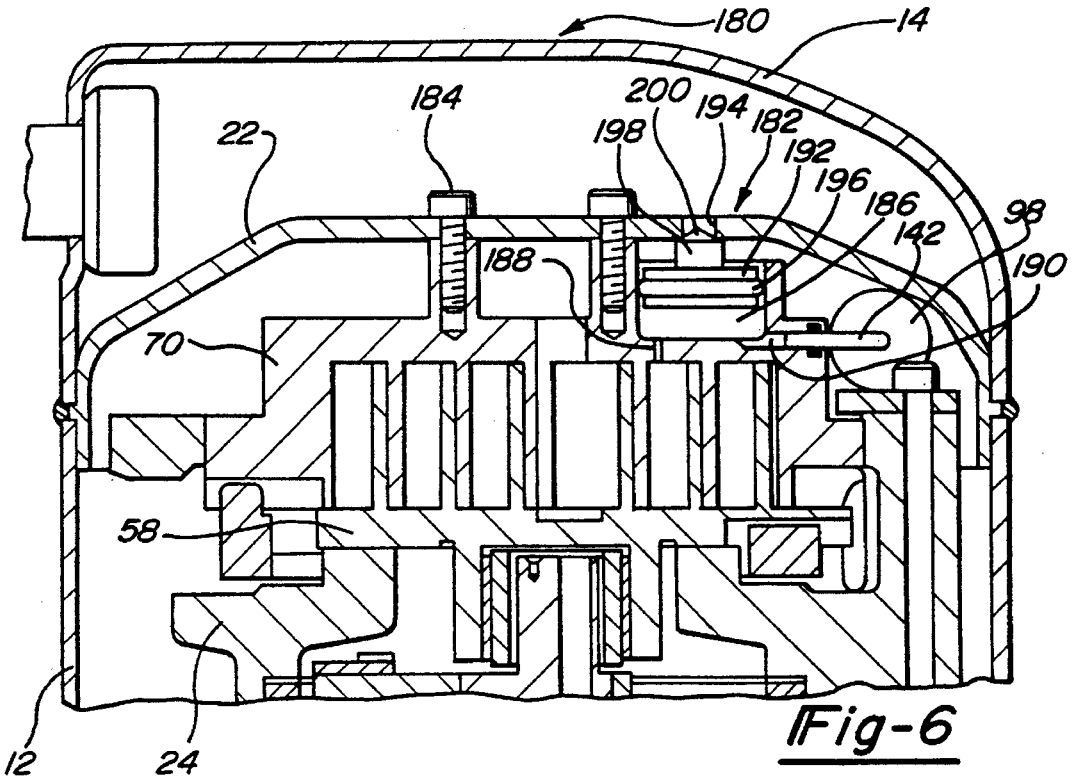
FIG. 6 is a vertical section through the upper portion of a scroll compressor which incorporates another embodiment of the present invention.

FIGS. 5 and 6 show another embodiment of the present invention. The embodiment shown in FIGS. 1 through 3 and the embodiment shown in FIG. 4 utilize the purging of intermediate pressure from an existing chamber in the compressor which is being utilized to bias one of the scroll members towards the other. The effect of purging this intermediate pressure from a biasing chamber is to create a leak between existing compressor components which then allows the discharge gas pressure and suction gas pressure to equalize. In some cases, it may be desirable to create a direct path for the discharge pressure to equalize with the suction pressure rather than relying on the movement or separation of various components of the compressor.

The embodiment shown in FIGS. 5 and 6 include a pressure ratio sensitive valve which directly bypasses discharge pressure to suction pressure. FIG. 5 shows a compressor 150 having a pressure ratio sensitive valve 152 incorporated into orbiting scroll 58. The design of compressor 150 in FIG. 5 is similar to the design of compressor 130 shown in FIG. 4 in that non-orbiting scroll 70 is a fixed scroll attached to shell 12 and cap 14. Main bearing housing 24 is provided with annular chamber 132 extending into flat thrust bearing surface 56. Seals 134 and 136 operate to prohibit fluid flow from chamber 132 to the suction side of compressor 150. Passageway 138 extends through orbiting scroll 58 and connects chamber 132 to an area of intermediate pressure within compressor 150. During operation of compressor 130, fluid at an intermediate pressure is supplied to chamber 132 through passageway 138. Orbiting scroll 58 is thus biased axially upward due to the fluid pressure within chamber 132. The fluid pressure within chamber 132 is maintained by seals 134 and 136.

The embodiment shown in FIG. 5 includes a passageway 140 extending through main bearing housing 24 and connecting chamber 132 to solenoid valve 98. The embodiment shown in FIG. 5 includes fluid tube 142 extending from passageway 140 which will allow the placement of solenoid valve 98 anywhere within the suction area of compressor 150 as space will permit. Up to this point, compressor 150 shown in FIG. 5 is the same as compressor 130 shown in FIG. 4 and the operation of compressor 150 is the same as the operation of compressor 130 as described above.

Compressor 150 further includes pressure ratio sensitive valve 152 disposed within a pocket 154 located within orbiting scroll 58. A discharge pressure passageway 156 extends between discharge passageway 74 and pocket 154. A suction pressure passageway 158 extends between pocket 154 and the suction area of compressor 150. A valve body 160 is disposed within pocket 154 and is axially movable within pocket 154 to allow or prohibit fluid flow between passageway 156 and passageway 158. Valve body 160 and pocket 154 are designed such that valve body 160 is capable of axial movement within pocket 154 but fluid flow between valve body 160 and pocket 154 is prohibited. The upper surface of valve body 160 has an annular ring 162 which separates the area above valve body 160 into an annular chamber 164 and a cylindrical chamber 166.

The operation of the embodiment shown in FIG. 5 is similar to the operation of compressor 130 shown in FIG. 4. At compressor start-up, solenoid 100 is energized and valve 102 is closed to block any fluid flow from passageway 140 through passageway 112. In this way compressor 150 makes a normal start-up. The time delay feature for compressor start-up may also be built into solenoid valve 98 for this embodiment. While compressor 150 is in operation, the position of valve body 160 is determined by the various pressures operating against respective surface areas of valve body 160. Intermediate pressure within chamber 132 exerts an upward force on valve body 160 equal to the amount of intermediate pressure times the surface area of valve body 160 exposed to chamber 132. Discharge pressure is being supplied to annular chamber 164 and thus exerts a downward force on valve body 160 equal to the amount of discharge pressure times the surface area of valve body 160 exposed to chamber 164. In a similar manner, suction pressure is being supplied to cylindrical chamber 166 and thus exerts a downward force on valve body 160 equal to the amount of suction pressure times the surface area of valve body 160 exposed to chamber 166. Thus, the opening and closing of pressure ratio sensitive valve 152 can be controlled by selecting the size of valve body 160 and the size and diameter of annular ring 162 to control the various surface areas.

At compressor shut-down, solenoid 100 is de-energized causing valve 102 to open and allow fluid flow through passageway 140 and 112 from chamber 132 to the suction area of compressor 150. As the intermediate pressure and suction pressure are equalized, both orbiting scroll 58 and valve body 160 are moved downward. The movement of scroll 58 causes a discharge gas to suction gas leak across the tips of scroll wraps 60 and 72 as explained above for the embodiment shown in FIG. 4. In addition, the movement of valve body 160 within pocket 154 allows discharge gas to flow from passageway 156 through passageway 158 thus creating a direct fluid flow between the discharge gas and the suction gas. The various controls including the size of passageway 140 and/or passageway 112 and the time delay at compressor shut down described above for the embodiment shown in FIG. 4 are also applicable to this embodiment. In addition, the amount of reverse rotation can be further controlled by the size of passageways 156 and 158 as well as the ratio of surface areas as described above for valve body 160.

FIG. 6 shows another embodiment of the present invention. FIG. 6 shows a compressor 180 having a pressure ratio sensitive valve 182 disposed within a pocket located within non-orbiting or fixed scroll 70. Similar to the embodiment shown in FIGS. 1 through 3, compressor 180 includes fixed scroll 70, orbiting scroll 58, shell 12, cap 14 and partition 22. Compressor 180 has fixed scroll 70 bolted directly to partition 22 by a plurality of bolts 184. Because non-orbiting or fixed scroll 70 does not move axially as in FIGS. 1 through 3, the need for floating seal 86 has been eliminated. Compressor 180 may or may not utilize biasing chamber 132 located within main bearing housing 24 in conjunction with seals 134 and 136 to bias orbiting scroll 58 towards fixed scroll 70 in a manner similar to that described for the embodiment shown in FIG. 4 but not shown in FIG. 6.

Compressor 160 includes pressure ratio sensitive valve 182 disposed within a pocket 186 located within fixed scroll 70. An intermediate pressure passageway 188 extends between an intermediate pressure zone within compressor 180 and pocket 186. A vent passageway 190 extends between pocket 186 and the inlet to solenoid valve 98. Solenoid valve 98 may be attached directly to fixed scroll 70 as shown in FIG. 1 or it may be located remotely from fixed scroll 70 by using tube 142 as shown in FIGS. 4 and 6. A valve body 192 is disposed within pocket 186 and is axially movable within pocket 186 to allow or prohibit fluid flow through an orifice 194 extending through partition 22. Valve body 192 and pocket 166 are designed such that valve body 192 is capable of axial movement within pocket 186 but fluid flow between valve body 192 and pocket 166 is prohibited by sliding seal 196. The upper surface of valve body 192 has a cylindrical extension 198 which is adapted with a valve seat 200 for sealing orifice 194.

The operation of the embodiment shown in FIG. 6 is similar to the operation of compressor 150 shown in FIG. 5. At compressor start-up, solenoid 100 is energized and valve 102 is closed to block any fluid flow from passageway 190 through passageway 112. In this way, compressor 180 makes a normal start-up. The time delay feature for compressor start-up may also be built into solenoid valve 96 for this embodiment. While compressor 180 is in operation, the position of valve body 192 is determined by the various pressures operating against respective surface areas of valve body 192. Intermediate pressure within pocket 186 exerts an upward force on valve body 192 equal to the amount of intermediate pressure times the surface area of the valve body 192. Discharge pressure is being supplied to orifice 194 and thus exerts a downward force on valve body 192 equal to the amount of discharge pressure times the area of orifice 194. In a similar manner, suction pressure is present at the upper end of pocket 186 and thus exerts a downward force on valve body 192 equal to the amount of suction pressure times the surface area of valve body 192 minus the surface area of orifice 194. Thus the opening and closing of pressure ratio sensitive valve 182 can be controlled by selecting the size of valve body 192 and the size of orifice 194.

At compressor shut-down, solenoid 100 is de-energized causing valve 102 to open and allow fluid flow through passageways 190 and 112 from pocket 186 to the suction area of compressor 180. As the intermediate pressure and suction pressure are equalized, valve body 192 moves downward due to discharge pressure at orifice 194. The movement of valve body 192 within pocket 186 creates a direct fluid flow between the discharge gas and the suction gas through orifice 194. The various controls including the size of passageway 190 and/or passageway 112 and the time delay at compressor shut down described for the embodiment in FIG. 4 are also applicable to this embodiment. In addition, the amount of reverse rotation can be further controlled by the size of orifice 194 in relationship to the size of valve body 192 as described above.

Figure 8:
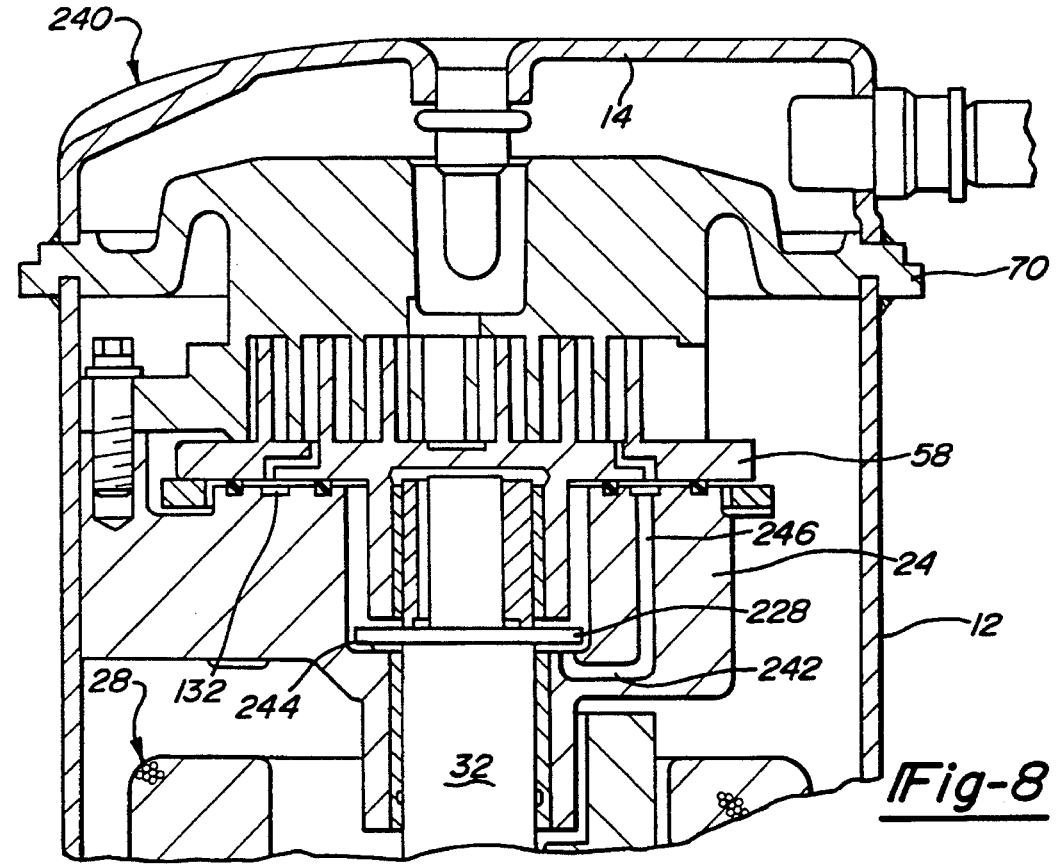
FIG. 8 is a vertical section through the upper portion of a scroll compressor which utilizes the compressor motor as a solenoid valve according to another embodiment of the present invention.
Figure 7:
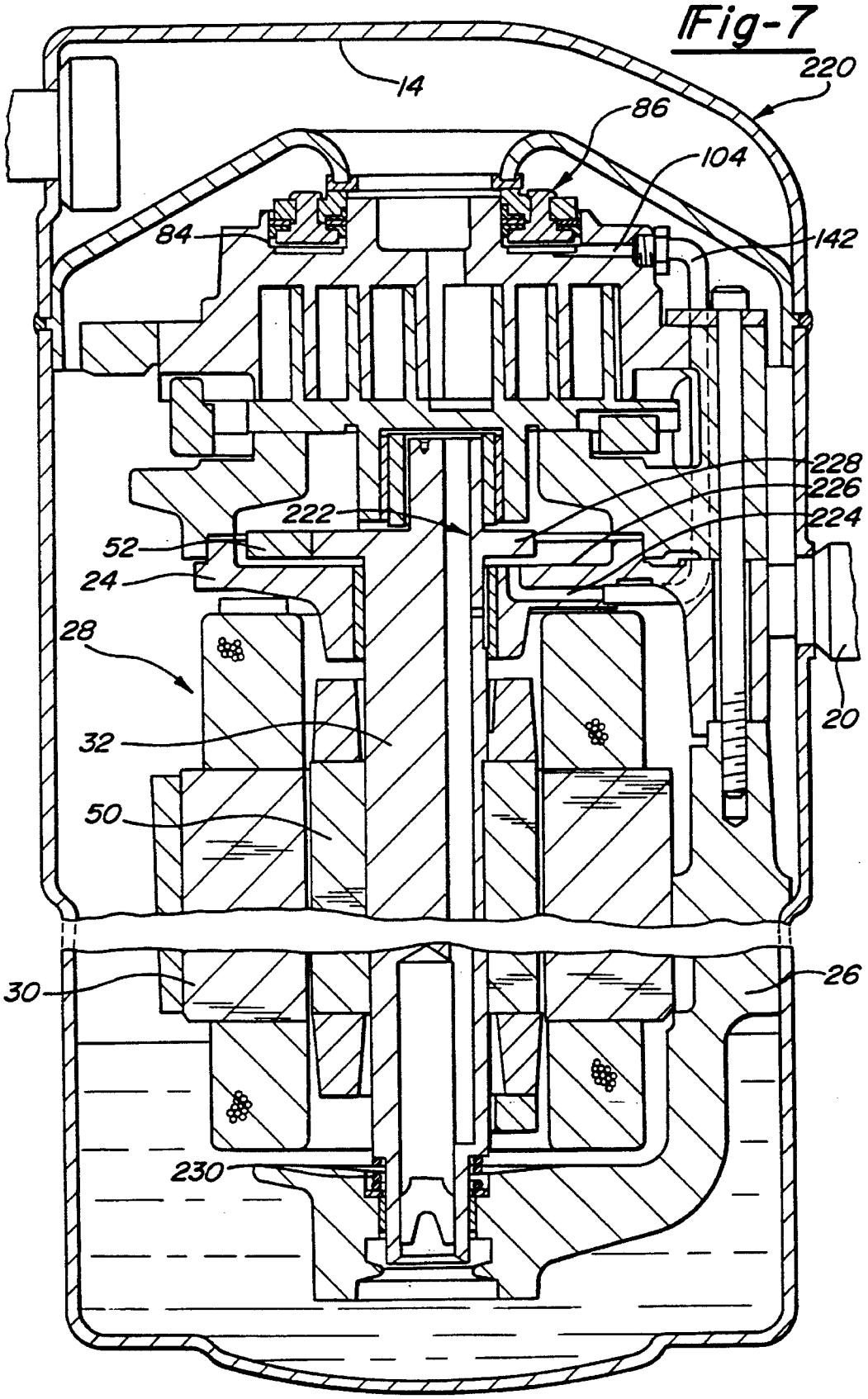
FIG. 7 is a vertical section through the center of a scroll compressor which utilizes the compressor motor as a solenoid valve.

FIGS. 7 and 8 show another embodiment of the present invention. FIGS. 7 and 8 eliminate the need for solenoid valve 98. Rather than using solenoid valve 98, the compressor shown in FIGS. 7 and 8 utilize motor 28 and crankshaft 32 to perform the switching function of solenoid valve 98. A solenoid is basically a wire coil which generates a magnetic field, which in turn pushes or pulls a plunger within the coil. This is very similar to the compressor motor. Motor stator 30 creates a rotating magnetic filed which tends to axially center motor rotor 50 within motor stator 30. The embodiment shown in FIGS. 7 and 8 use this centering force in conjunction with an opposing spring force to create the same result as a solenoid.

FIG. 7 shows compressor 220 which is similar to compressor 10 shown in FIG. 1 except that solenoid valve 98 has been replaced by tube 142 and a valve 222 which uses motor 28 and crankshaft 32 for opening and closing. Passageway 104 extends through non-orbiting scroll 70 and is sealingly secured to tube 142. Tube 142 is routed through compressor 220 and its opposite end is sealingly secured to a passageway 224 extending through main bearing housing 24. Passageway 224 extends from one side of main bearing housing 24 to an upper surface 226 where it is open to the suction area of compressor 220. Crankshaft 32 extends through main bearing housing 24 and has an annular sealing flange 228 attached to crankshaft 32 at a position adjacent to upper surface 226. In the embodiment shown in FIG. 7, flange 228 is shown integral with crankshaft 32 and upper counterweight 52 is attached to flange 228. It is within the scope of the present invention to have flange 228 and counterweight 52 formed as one piece and attached to crankshaft 32 if desired. Crankshaft 32 is normally biased upward by a biasing spring 230 positioned between lower bearing housing 26 and crankshaft 32 such that sealing flange 228 is biased away from upper surface 226 and passageway 224 is open to the suction area of compressor 220.

At compressor start-up, crankshaft 32 is forced downward against the load of biasing spring 230 due to the centering force created by the magnetic field of motor 28 which tends to axially center motor rotor 50 and thus crankshaft 32 within motor stator 30. This downward movement of crankshaft 32 brings into contact sealing flange 228 and upper surface 226 which prohibits fluid flow through passageway 224. In this manner, compressor 220 makes a normal start-up.

At compressor shut-down, power to motor 28 is cut off eliminating the magnetic field which tends to center motor rotor 50 within motor stator 30. Crankshaft 32 is once again biased upwards by spring 230 separating sealing flange 228 from upper surface 226 and opening passageway 224 to the suction area of compressor 220. The fluid flow from passageway 104, through tube 142 and through passageway 224 allows fluid flow from the bottom of chamber 84 to the suction area of compressor 220. As the intermediate pressure and suction pressure are equalized, floating seal 86 has a net downward force due to the discharge gas pressure and a discharge gas to suction gas leak is created identical to that described for FIG. 1.

FIG. 8 shows another embodiment of the present invention which is similar to the embodiment in FIG. 4 but utilizes motor 28 and crankshaft 32 as the valve similar to that described above for FIG. 7. FIG. 8 shows a compressor 240 which includes an intermediate gas pressure biasing chamber 132 similar to that shown in FIG. 4. Compressor 240 also includes a passageway 242 which extends from a horizontal surface 244 on bearing housing 24 to meet a passageway 246 extending from biasing chamber 132.

The operation of compressor 240 is identical to the operation of compressor 220 described above except that the intermediate pressure is released from below the orbiting scroll rather than from below floating seat 86 and the discharge gas to suction gas leak is created identical to that described in FIG. 4. In addition, it should be appreciated that a pressure ratio sensitive valve as described in the embodiments shown in FIGS. 5 and 6 may also be incorporated into compressor 240 if desired.

Figure 9:
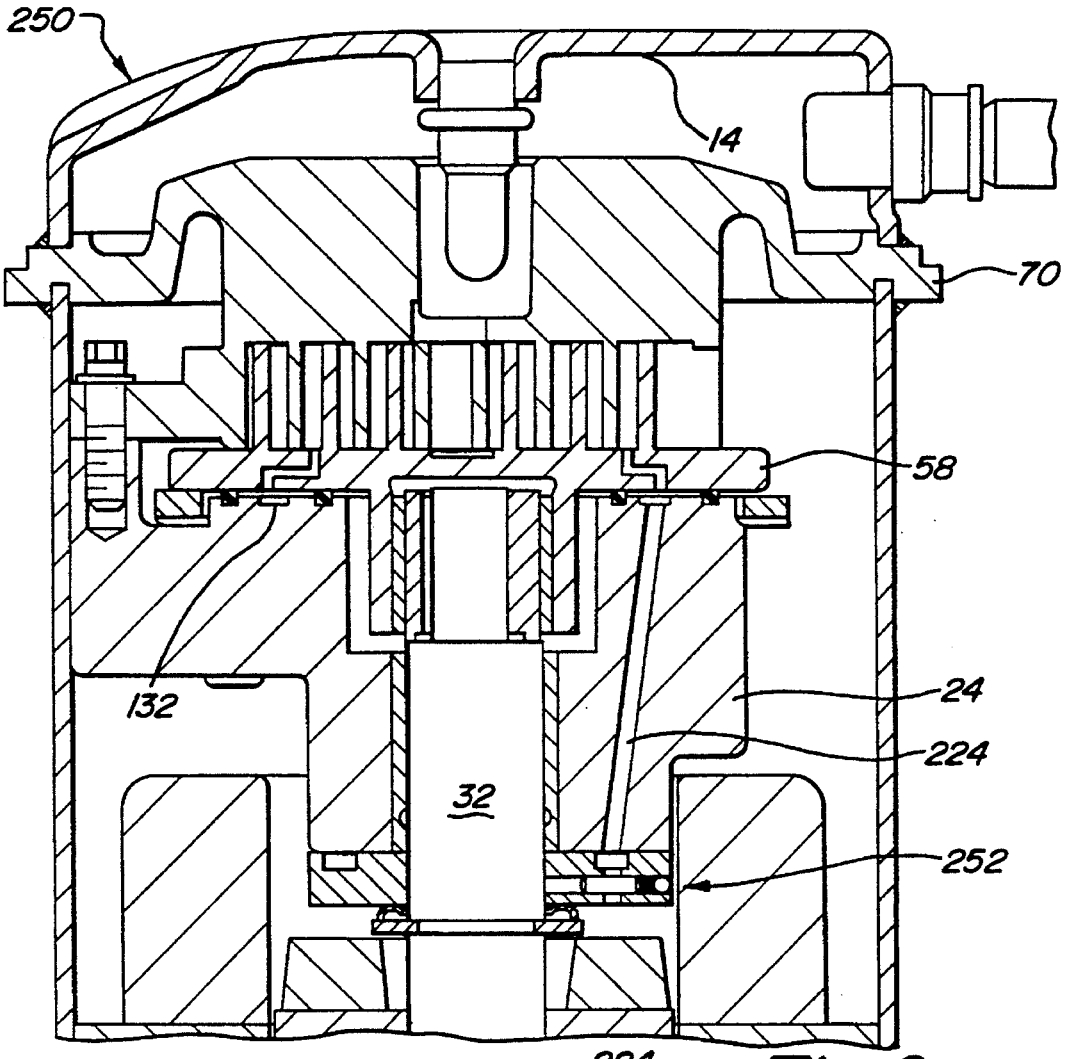
FIG. 9 is a schematic of a vertical section through the upper portion of a scroll compressor which utilizes a centrifugal valve for releasing intermediate pressure.
Figure 10:
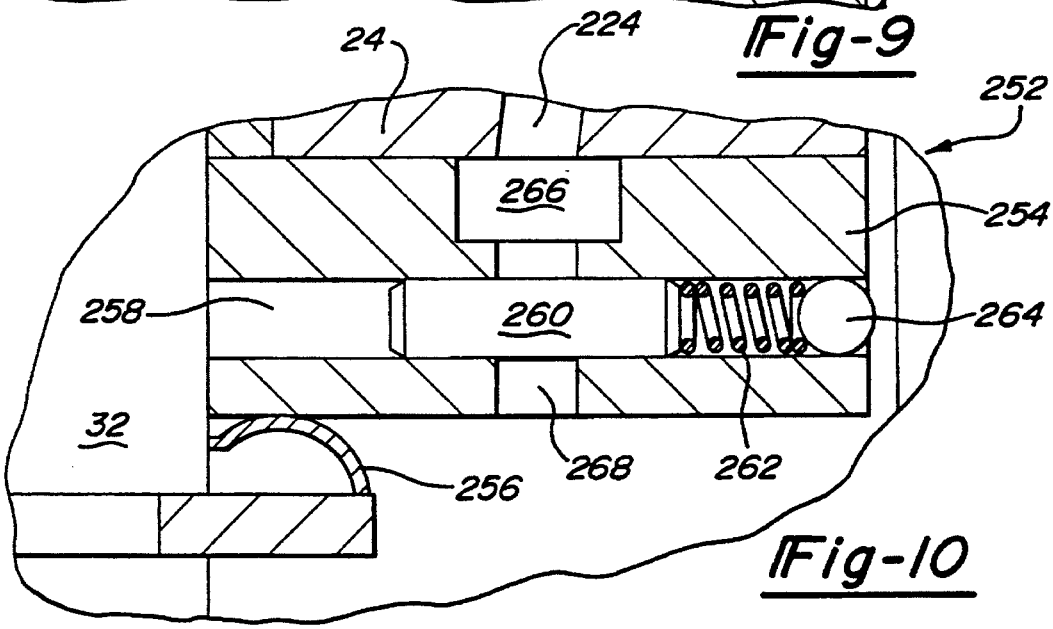
FIG. 10 is an enlarged sectional view of the centrifugal valve shown in FIG. 9 shown in the closed position.

FIGS. 9 and 10 show another embodiment of the present invention. The embodiment shown in FIGS. 9 and 10 makes use of centrifugal force to activate a valve above a predetermined rotational speed. This valve is biased to an open position at low speed allowing the purging of the intermediate pressure gas. It is to be appreciated that this centrifugal valve can be utilized with any of the embodiments described above whereby the centrifugal valve replaces the solenoid valve.

FIGS. 9 and 10 show a compressor 250 which incorporates a centrifugal valve 252 to replace solenoid valve 98. Centrifugal valve 252 as best shown in FIG. 10 includes a valve body 254 secured to crankshaft 32 for rotation therewith but capable of axial movement along crankshaft 32. A valve spring 256 biases valve body 254 axially along crankshaft 32 and sealingly engages valve body 254 with main bearing housing 24. A first passageway 258 extends radially through valve body 254. A valve 260 is slidingly received within passageway 258 and is biased radially inward by a coil spring 262. The radial outward end of passageway 258 is closed by a ball 264 which also provides for a reaction point for coil spring 262.

The upper surface of valve body 254 which is opposite to valve spring 256 is provided with an annular groove 266 which is in communication with passageway 224 in main bearing housing 24. An axial passageway 268 extends from annular groove 266 through radial passageway 258 and into the suction area of compressor 250. When coil spring biases valve 260 radially inward, passageway 224 is open to the suction area of compressor 250 through groove 266 and axial passageway 268. When centrifugal force urges valve 260 radially outward against the load of coil spring 262, valve 260 will block axial passageway 268 and prohibit fluid flow from passageway 224 to the suction area of compressor 250.

At compressor start-up, valve 260 is biased radially inward by coil spring 262. As the rotational speed of crankshaft 32 and centrifugal valve 252 increases, valve 260 is forced radially outward to block axial passageway 268. In this manner, compressor 250 makes a normal start-up.

At compressor shut-down, valve 260 will remain in a position to block axial passageway 268 until such a time that the load exerted by coil spring 262 exceeds the centrifugal force exerted on valve 260 as the rotational speed of centrifugal valve 252 decreases. Eventually valve 260 will move sufficiently inward to open axial passageway 268 and the intermediate pressure within passageway 224 will be purged to the suction area of compressor 250. The purging of the intermediate pressure to suction pressure has the identical effect as described above for the previous embodiments. The rate control for this embodiment would involve the size of axial passageway 268, the weight of valve 260 and the rate for coil spring 262.

It is to be appreciated that the embodiment shown in FIGS. 9 and 10 can replace the solenoid valve in any of the various embodiments described above.

Figure 11:
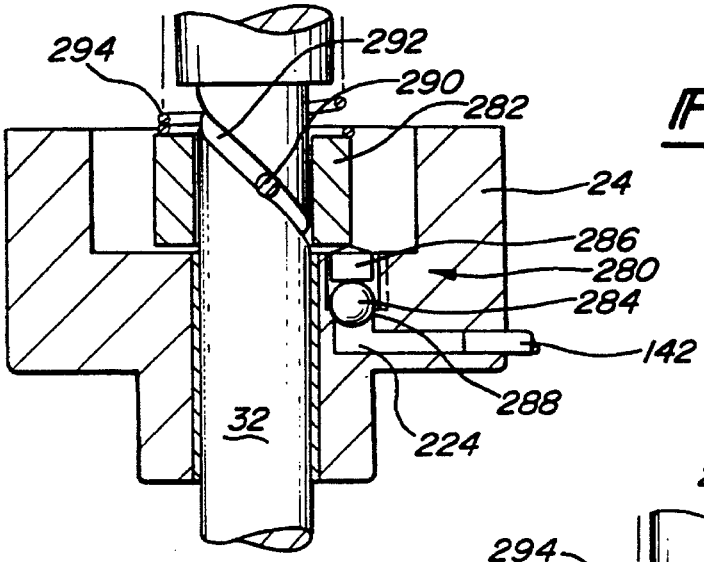
FIG. 11 is a schematic view of a vertical section through the center of a scroll compressor which utilizes angular acceleration of a component of the compressor to activate a valve (shown in the closed position) which releases intermediate pressure.
Figure 12:
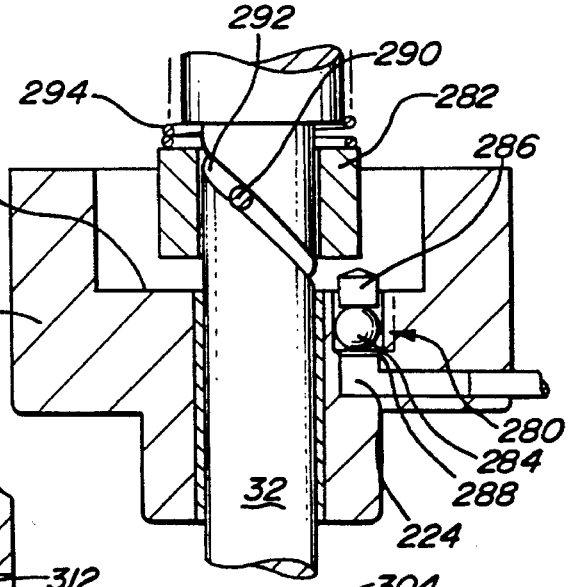
FIG. 12 is a schematic view of a vertical section through the center of a scroll compressor which utilizes angular acceleration of a component of the compressor to activate a valve (shown in the open position) which releases intermediate pressure.

FIGS. 11 and 12 show schematically another embodiment of the present invention. The embodiment shown in FIGS. 11 and 12 uses angular acceleration at start-up to block a vent hole, and deceleration at shut-down to unblock the vent hole and allow the purging of intermediate gas pressure to suction gas pressure. FIGS. 11 and 12 schematically represent the reverse rotation protection of this embodiment of the present invention and include crankshaft 32, main bearing housing 24, passageway 224, a valve 280 and a collar 282.

Valve 280 is located within passageway 224 at the point where passageway 224 extends through upper surface 244. Valve 280 includes a ball 284, an activation device 286 and a valve seat 288. Collar 280 is slidingly received on crankshaft 32 at a position adjacent to upper surface 244 on main bearing housing 24. Collar 282 includes a pin 290 which extends through collar 282 and is disposed in a spiral groove 292 located in crankshaft 32. A coil spring 294 biases collar 282 downward towards upper surface 244 on main bearing housing 24. In the lower position shown in FIG. 11, collar 282 contacts activation device 286 which in turn forces ball 284 against valve seat 288 to prohibit movement of fluid through passageway 224. When collar 282 is moved away from upper surface 244 by relative movement of collar 282 on crankshaft 32 as shown in FIG. 12, the intermediate pressure acting against ball 284 forces ball 284 upward opening passageway 224 to the suction area of the compressor.

At compressor start-up, as shown in FIG. 11, positive angular acceleration of crankshaft 32 causes relative movement between crankshaft 32 and collar 282 due to the inertial effects on collar 282. The direction of spiral groove 292 is such that this positive angular acceleration of crankshaft 32 causes pin 290 to move downward in groove 292 forcing collar 282 against upper surface 226 and closing valve 280 by forcing ball 284 against valve seat 288. In this manner, the compressor makes a normal start-up.

At compressor shut-down, as shown in FIG. 12, the opposite is true. A negative angular acceleration of crankshaft 32 causes relative movement between crankshaft 32 and collar 282 again due to the inertial effects on collar 282. The direction of spiral groove 292 now causes pin 290 to move upward in groove 292 due to this negative angular acceleration. As pin 290 moves upward in groove 292, collar 282 is moved away from face 244 and the intermediate pressure beneath ball 284 forces ball 284 off of valve seat 288 and passageway 224 is open to the suction area of the compressor allowing the purging of the intermediate pressure.

It is to be appreciated that the embodiment shown in FIGS. 11 and 12 can replace the solenoid valve in any of the various embodiments described above.

Figure 13:
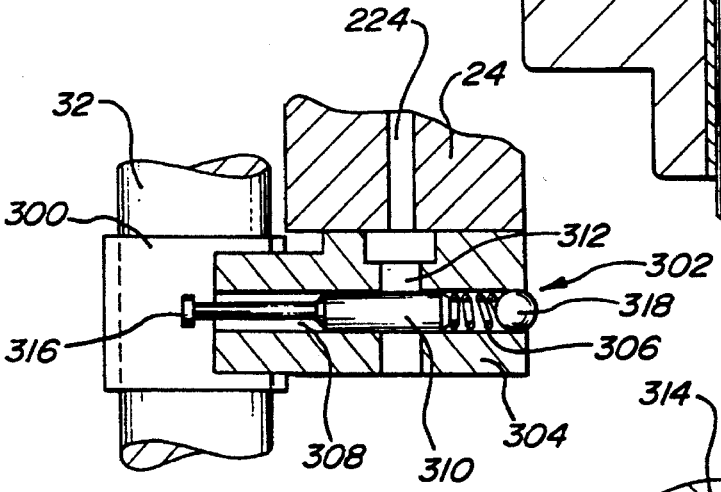
FIG. 13 is a schematic view of a vertical section through the center of a scroll compressor which utilizes viscous drag of a component of the compressor to activate a valve, shown in the closed position, which releases intermediate pressure.
Figure 14:
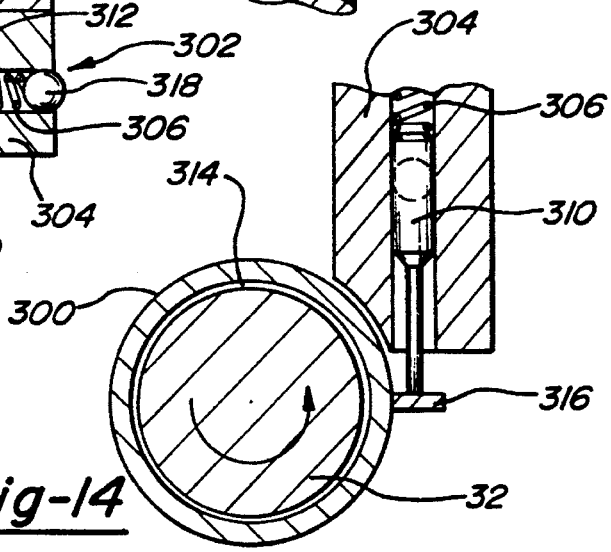
FIG. 14 is a horizontal sectional view through the crankshaft and collar shown in FIG. 13.

FIGS. 13 and 14 show another embodiment of the present invention. The embodiment shown in FIGS. 13 and 14 uses a viscous drag caused by a rotating component of the compressor. In FIGS. 13 and 14, the rotating component shown is crankshaft 32, although any rotating component within the compressor could be used. Viscous drag caused by a rotating component can generate sufficient force to rotate a spring loaded device into a position to block a vent hole or to actuate a valve. FIGS. 13 and 14 schematically represent the reverse rotation protection of this embodiment of the present invention and include crankshaft 32, a collar 300 and a valve 302. Valve 302 includes a valve body 304, a valve spring 306, a first passageway 308, a valve 310 and a second passageway 312.

Collar 300 is slidingly received on crankshaft 32 as shown in FIGS. 13 and 14. The relationship between the outside diameter of crankshaft 32 and the inside diameter of collar 300 is such that a viscous fluid film 314 exists between crankshaft 32 and collar 300. When collar 300 is prohibited from rotating with crankshaft 32, the rotating of crankshaft 32 attempts to shear viscous fluid film 314 between the two components. This shearing of the viscous fluid will cause a torque to be applied to collar 300 as viscous fluid film 314 attempts to rotate collar 300 with crankshaft 32. Collar 300 is provided with a radially extending paddle 316 which is used to activate valve 302 as will be described later herein.

Valve body 304 may be secured to main bearing housing 24 similar to the attachment of valve 104 to non-orbiting scroll 70 shown in FIGS. 1 through 3 or valve body 304 may be separate from main bearing housing and provided with intermediate pressure by tube 142.

First passageway 308 extends longitudinally through valve body 304. Valve 310 is slidingly received within passageway 308 and is biased towards paddle 316 of collar 300 as shown in FIG. 13 by valve spring 306. The end of passageway 308 opposite to valve 310 is closed by a ball 318 which also provide for a reaction point for valve spring 306.

Second passageway 312 extends through valve body 304 and through first passageway 308 generally perpendicular to first passageway 308. One end of second passageway 312 is connected to the source of intermediate pressure either directly through passageway 224 or through tube 142. The opposite end of second passageway 312 is open to the suction area of the compressor. When valve spring 306 biases valve 310 towards paddle 316, second passageway 312 is open and the source of intermediate pressure is open to the suction area of the compressor. When torque is applied to collar 300, due to the viscous drag, paddle 316 exerts a load on valve 310 which overcomes the force of valve spring 306 and moves valve 310 to a position which blocks second passageway 312 and prohibits the source of intermediate pressure from purging to the suction area of the compressor.

At compressor start-up, valve 310 is biased towards paddle 316 by valve spring 306. As the rotational speed difference between crankshaft 32 and collar 300 increases, the torque exerted on collar 300 increases due to the shear of viscous fluid film 314 between crankshaft 32 and collar 300. The rotation of collar 300 with crankshaft 32 is prohibited by paddle 316 contacting valve 310. As the torque on collar 300 increases, the load on valve 310 increases and valve 310 is forced longitudinally within first passageway 308 against valve spring 306 to block second passageway 312. In this manner, compressor 250 makes a normal start-up.

At compressor shut-down, valve 310 will remain in a position to block second passageway 312 until such a time that the load exerted by valve spring 306 exceeds the load exerted by paddle 316 on valve 310 as the rotational speed difference between crankshaft 32 and collar 300 decreases. Eventually valve 310 will move sufficiently inward to open second passageway 312 and the source of intermediate pressure will be purged to the suction area of the compressor. The purging of the intermediate pressure in this embodiment has the identical effect as described for the previous embodiments. The rate control for this embodiment would include the size of second passageway 312, the rate for valve spring 306 and the width of fluid film 314.

It is to be appreciated that the embodiment shown in FIGS. 13 and 14 can replace the solenoid valve in any of the various embodiments described above.

Figure 15:
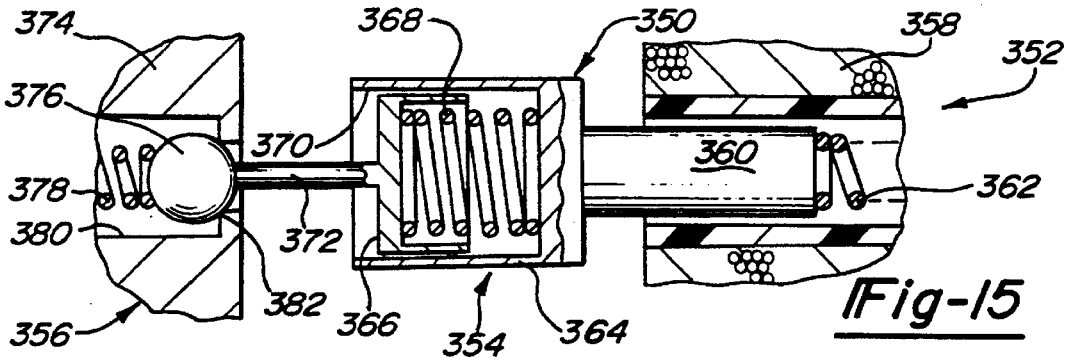
FIG. 15 is a schematic view of a fail safe device for a solenoid valve shown in a first position.
Figure 16:
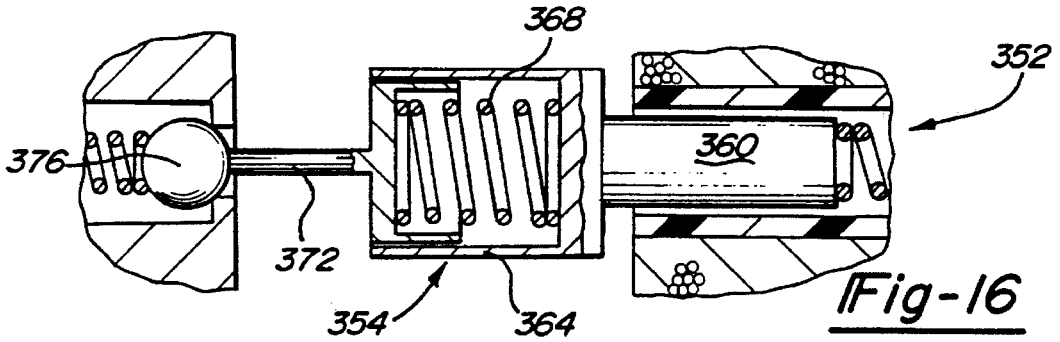
FIG. 16 is a schematic view of a fail safe device for a solenoid valve shown in a second position.
Figure 17:
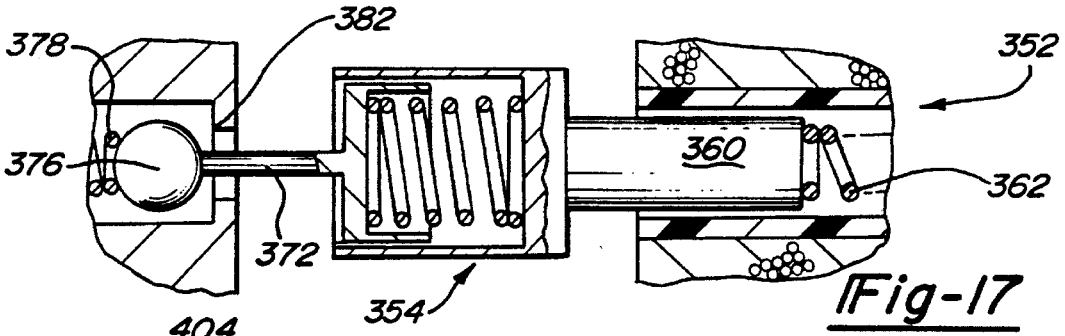
FIG. 17 is a schematic view of a fail safe device for a solenoid valve shown in a third position.

FIGS. 15 through 17 illustrate schematically a fail-safe device which may be incorporated into a solenoid valve 350 which would be a replacement for solenoid valve 98 of the previous embodiments. Solenoid valve 350 operates similar to the operation of solenoid valve 98. Solenoid valve 98, when energized, pushes ball 114 onto valve seat 116 to prohibit fluid flow through passageway 112. Solenoid valve 350, when energized, moves away from a ball to allow the ball to seat on a valve seat. When solenoid valve 350 is de-energized it pushes the ball off of the valve seat to allow fluid flow through the valve.

FIGS. 15 through 17 schematically illustrate solenoid valve 350 which includes a solenoid 352, a dashpot 354 and a valve 356. Solenoid 352 comprises a cylindrical wire coil 358, surrounding a plunger 360 in the usual manner. A return spring 362 forces plunger 360 towards the left as shown in FIG. 15. Dashpot 354 comprises an outer housing 364 which is fixedly secured to plunger 360, an inner housing 366, and a dashpot spring 368. Inner housing 366 is slidingly received within a pocket 370 located within outer housing 364. Dashpot spring 368 is disposed within pocket 370 and urges inner housing 366 to the left as shown in FIG. 15. Inner housing 366 includes an actuation pin 372 which extends from housing 366 towards valve 356 for opening and closing valve 356 as will be described later herein. Valve 356 comprises a valve body 374, a ball 376 and a valve spring 378. Valve body 374 includes a bore 380 extending longitudinally within valve body 374. Ball 376 is disposed within bore 380 and is urged to the right as shown in FIG. 15 against a valve seat 382 by valve spring 378. The source of intermediate pressure is supplied to bore 380 either directly or by tube 142.

The operation of solenoid valve 350 begins with solenoid 352 being de-energized, dashpot 354 being collapsed and valve 356 being closed due to valve spring 378 urging ball 376 against valve seat 382. This position is illustrated schematically in FIG. 15. Activation pin 372 is biased against ball 376 by dashpot spring 368 but it is not able to unseat ball 376 due to the force exerted on ball 376 by valve spring 378. The rate of valve spring 378 is chosen to be higher than the rate of dashpot spring 368.

At compressor start-up, as shown in FIG. 16, solenoid 352 is energized and plunger 360 is urged to the right as shown in FIG. 16. This urges outer housing 364 to the right also and dashpot 354 extends axially due to the load exerted by dashpot spring 368. This extension of dashpot 354 maintains the contact between activation pin 372 and ball 376. In this manner, the compressor will have a normal start-up.

At compressor shut-down, as shown in FIG. 17, solenoid 352 is de-energized and plunger 360 is forced to the left as shown in FIG. 17 due to return spring 362. The movement to the left of plunger 360 moves dashpot 354 to the left causing activation pin 372 to unseat ball 376 from valve seat 382. Valve spring 378 is unable to overcome the load exerted by activation pin 372 due to the force being exerted by return spring 362 and the resistance to collapsing of dashpot 354. The rate of return spring 362 is chosen to be higher than the rate of valve spring 378. Ball 376 will remain unseated from valve seat 382 for a period of time defined by the design of dashpot 354. Valve spring 378 will eventually work to collapse dashpot 354 and seat ball 376 against valve seat 382. This returns solenoid valve 350 to the position shown in FIG. 15. During the time that ball 376 is unseated from valve seat 382, the gas at intermediate pressure will be purged to the suction area of the compressor. The purging of the intermediate pressure in this embodiment has the identical effect as described for the previous embodiments. The rate control for this embodiment would include the size of valve seat 382, the rates for springs 362, 368 and 378 as well as the rate for dashpot 354.

The fail safe feature of solenoid valve 350 works by allowing valve 356 to remain seated if plunger 360 fails to retract at start-up, fails to return at shut-down or is stuck in any other position for whatever reason. If dashpot 354 itself fails, in either the collapsed or extended position, the compressor will function in a normal manner albeit with a loud shut-down.

It is to be appreciated that the fail safe feature of the embodiment shown in FIGS. 15 through 17 can be incorporated into the solenoid valve in any of the various embodiments described above.

Figure 18:
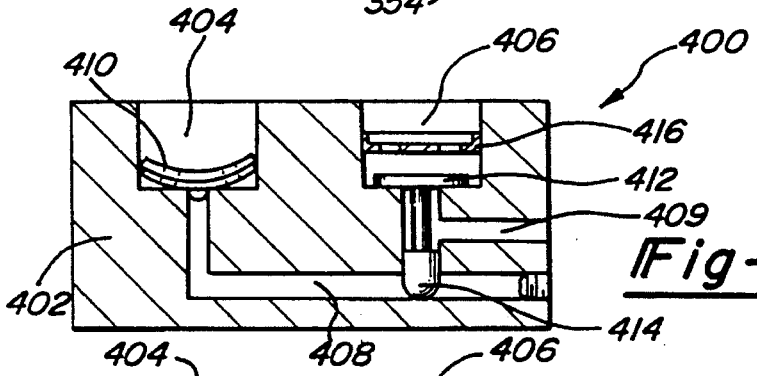
FIG. 18 is a schematic of a thermal valve, shown in the closed position, for releasing intermediate pressure to the suction area of the compressor.
Figure 19:
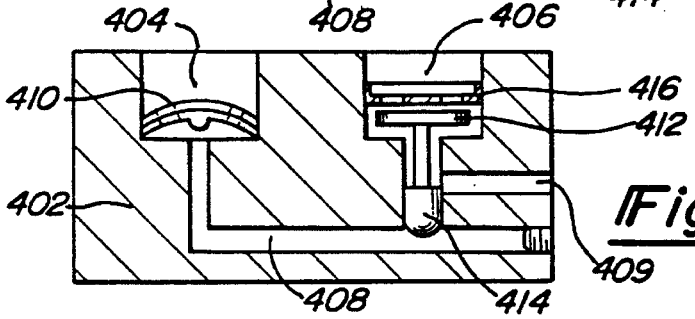
FIG. 19 is a schematic of a thermal valve, shown in the open position, for releasing intermediate pressure to the suction area of the compressor.

FIGS. 18 and 19 show another embodiment of the present invention. In the previously detailed embodiments the purging of the intermediate pressurized gas to the suction area of the compressor was directly related to the start-up and shut-down of the compressor. The embodiment shown in FIGS. 18 and 19 uses a thermal switch to activate the purging of the source of intermediate pressurized gas to the suction area of the compressor. Once the thermal protector is switched, the dumping of the source of intermediate pressurized gas will allow discharge gas to leak to the suction area of the compressor as detailed above in the previous embodiments. The discharge gas to suction leak will lower the operating pressure ratio of the compressor and the discharge side temperature. Eventually the motor protector for the compressor will take the compressor off line due to high temperature discharge gas being leaked to the suction area of the compressor where the motor and motor protector are located.

FIGS. 18 and 19 illustrate schematically the thermal responsive valve of the present invention which is generally designated by reference numeral 400. Valve 400 comprises a valve body 402, a first chamber 404, a second chamber 406, a discharge pressure passageway 408 and a suction pressure passageway 409. Valve body 402 can be a separate component or valve body 402 may be an integral part of non-orbiting scroll 70, main bearing housing 24 or any other component within the compressor.

First chamber 404 extends into valve body 402 and is placed in communication with the discharge gas of the compressor. Discharge pressure passageway 408 extends from the lower end of chamber 404 and fluidically connects chamber 404 with the lower end of chamber 406. A thermo-disc (TOD) 410 is located on the step formed by chamber 404 and passageway 408. TOD 410 remains seated prohibiting discharge gas flow from chamber 404 to passageway 408. When a predetermined critical temperature is encountered, TOD 410 opens and allows full flow of discharge gas from chamber 404 to passageway 408.

Second chamber 406 is a stepped chamber also extending into valve body 402. The upper or larger portion of chamber 406 is placed in communication with the source of intermediate pressurized gas. The lower or smaller portion of chamber 406 is placed in communication with chamber 404 through passageway 408. Suction pressure passageway 409 extends from a suction gas area within the compressor to the lower portion of chamber 406. The point at which suction pressure passageway 409 enters chamber 406 is between high pressure passageway 408 and the upper or larger portion of chamber 406.

A flat check valve 412 having a piston 414 extending from it is disposed within chamber 406. Flat check valve 412 and piston 414 move together within chamber 406 from a closed position as shown in FIG. 18 to an open position as shown in FIG. 19. A retainer 416 limits the movement of flat check valve 412 and piston 414 within chamber 406. In its closed position, as shown in FIG. 18, flat check valve 412 seats against the step formed in chamber 406 to prohibit fluid flow from the source of intermediate pressurized gas being supplied to the upper portion of chamber 406 to suction pressure passageway 409. Flat check valve 412 is forced downward due to the intermediate pressurized gas reacting on the exposed area of the step of check valve 412 and suction gas pressure reacting on the exposed area of piston 414. Flat check valve 412 will be forced upward due to the discharge gas pressure acting against piston 414 when TOD 410 is in the open condition. In its open position, as shown in FIG. 19, flat check valve 412 is lifted from the stepped portion of chamber 406 and gas at intermediate pressure is allowed to leak to the suction side of the compressor. Retainer 416 limits the movement of flat check valve 412 such that discharge gas within passageway 408 is not allowed to flow into the suction area of the compressor.

Thermal responsive valve 400 is normally positioned as shown in FIG. 18. Discharge gas is being supplied to chamber 404 and intermediate pressurized gas is being supplied to chamber 406. The compressor operates normally as long as TOD 410 remains closed. When TOD 410 experiences an over temperature condition of the discharge gas within chamber 404, TOD 410 opens and allows discharge gas to enter passageway 408. The pressure of the discharge gas reacts against the exposed surface area of piston 414 raising flat check valve 412 which allows the source of intermediate pressurized gas in communication with chamber 406 to purge through passageway 409 and into the suction area of the compressor. This purging of the intermediate gas within the compressor allows a discharge gas to suction gas leak with the effects as described above for the various embodiments. Because the opening of TOD 410 is not tied in with the shutting down of the motor of the compressor, the motor will continue to run with the compressor having a lower operating pressure ratio and a lower discharge side temperature. The motor will continue to run until the motor protector takes the compressor off line due to the high temperature discharge gas being leaked into the suction area of the compressor where the motor and motor protector are located.

Figure 20:
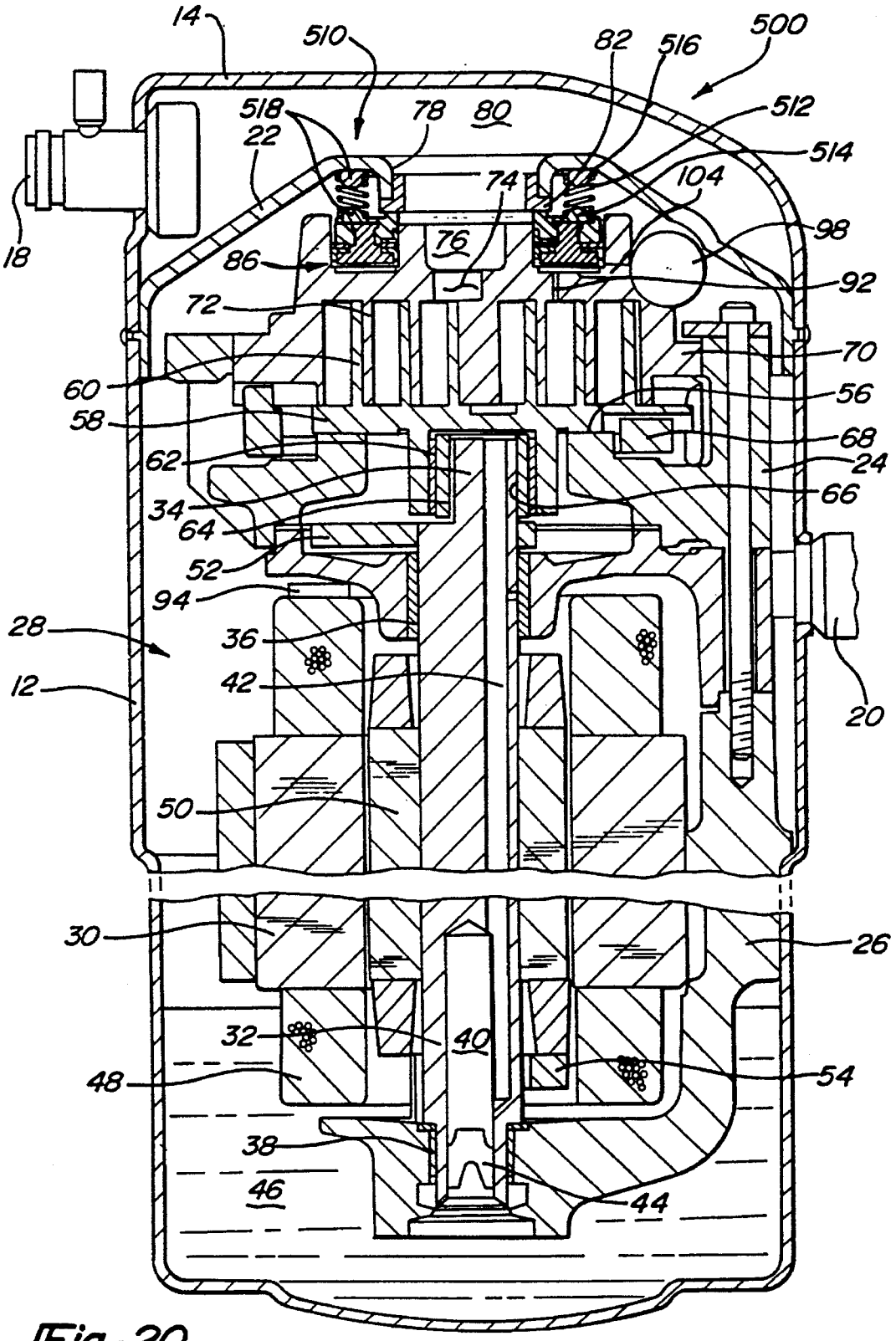
FIG. 20 is a vertical sectional view through the center of a scroll compressor which incorporates an additional embodiment of the present invention.
Figure 21:
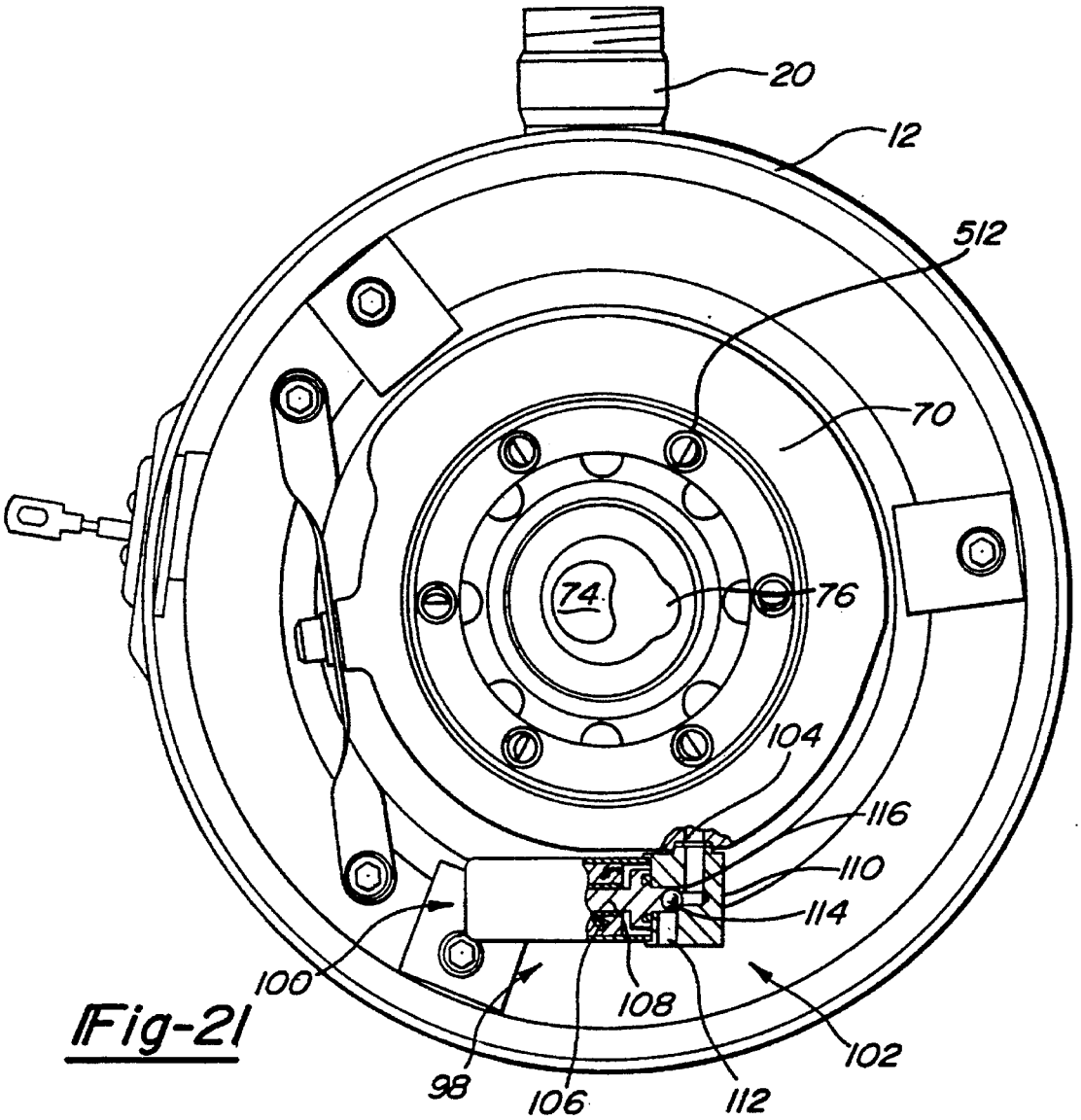
FIG. 21 is a top elevational view of the compressor shown in FIG. 20 with the cap and partition removed.
Figure 22:
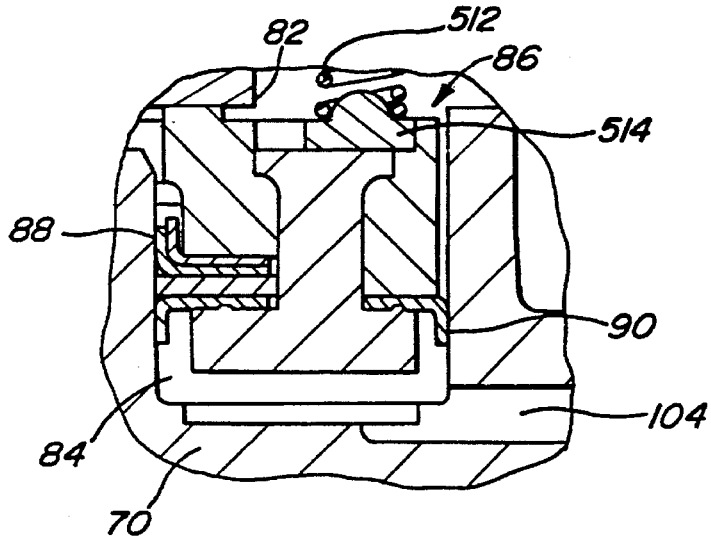
FIG. 22 is a fragmentary enlarged view of a portion of the floating seal illustrated in FIG. 20.

FIGS. 20 through 22 illustrate another embodiment of the present invention. FIGS. 20 through 22 show a compressor 500 which incorporates unique floating seal biasing means 510. The reference numerals shown in FIGS. 20 through 22 which are identical to those shown in FIGS. 1 through 3 respectably depict like or corresponding components in both figures. Compressor 500 incorporates biasing means 510 in order to be able to control the rate at which intermediate pressure is bled to suction pressure which will in turn control the rate at which discharge pressure is bled to suction pressure. It has been found that dumping the intermediate pressure too quickly will cause compressor 500 to coast and become noisy. Dumping the intermediate pressure too slowly introduces the problems associated with reverse rotation of compressor 500. Thus, it is desirable to control the rate of dumping intermediate pressure to suction pressure which will in turn control the rate at which discharge pressure is dumped to suction pressure.

Biasing means 510 comprises a plurality of coil springs 512 and a pair of spacing rings 514 and 516. Coil springs 512 are disposed between spacing rings 514 and 516. Each spacing ring 514 and 516 define a plurality of circumferentially spaced tabs 518 which both position and retain the plurality of coil springs 512 between plates 514 and 516. Plate 514, plate 516 and coil springs 512 are located between transversely extending partition 22 and floating seal 86 such that floating seal 86 is biased by coil springs 512 away from partition 22. This biasing of floating seal 86 acts to control the rate of opening the discharge gas to suction gas leak across the top of floating seal 86 at annular seat portion 82.

At compressor start-up, solenoid 100 is energized and valve 102 is closed to block any fluid flow through passageway 104. In this manner, compressor 500 makes a normal start-up because the pressure in cavity 84 increases quickly to overcome the biasing load of coil springs 512. The option to build in a time delay to the activation of solenoid 100 to improve start-up operation can be incorporated into compressor 500 similar to that described for compressor 10 if desired.

At compressor shut-down, solenoid 100 is de-energized at the same instant that power to motor 28 is cut off. The de-energizing of solenoid 100 causes valve 102 to open and allows fluid flow through passageways 104 and 112 from recess 84 to the suction area of compressor 500. The plurality of springs 512 helps to control the rate of dumping of intermediate pressure to suction pressure and as intermediate pressure and suction pressure become equalized, floating seal 86 has a net downward force due to discharge gas pressure and the plurality of coil springs 512 and floating seal 86 moves downward in recess 84 and creates a discharge gas to suction gas leak across the top of floating seal 86 at annular seat portion 82. The plurality of coil springs 512 help to control the rate of dumping of intermediate pressure gas to suction pressure which controls the rate of downward movement of floating seal 86 which in turn controls the rate of discharge gas to suction gas dumping. Thus, by selecting the appropriate size for the plurality of coil springs 51 2, the size of passageway 104 and/or passageway 112, reverse rotation of compressor 500 may be minimized to any acceptable reverse RPM or it can be completely eliminated.

Figure 23:
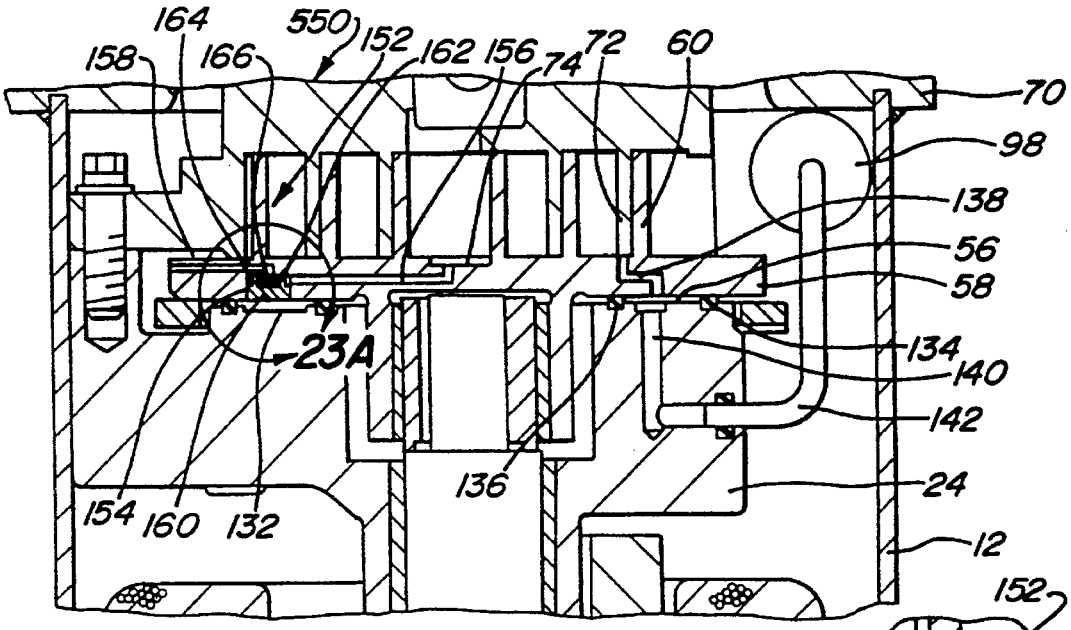
FIG. 23 is a vertical section through the upper portion of a scroll compressor which incorporates another embodiment of the present invention.
Figure 23A:
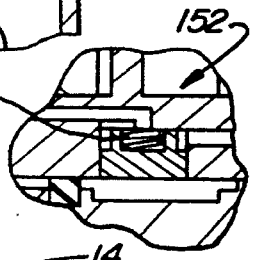
FIG. 23A is an enlarged view of the area identified by circle 23A in FIG. 23.
Figure 24:
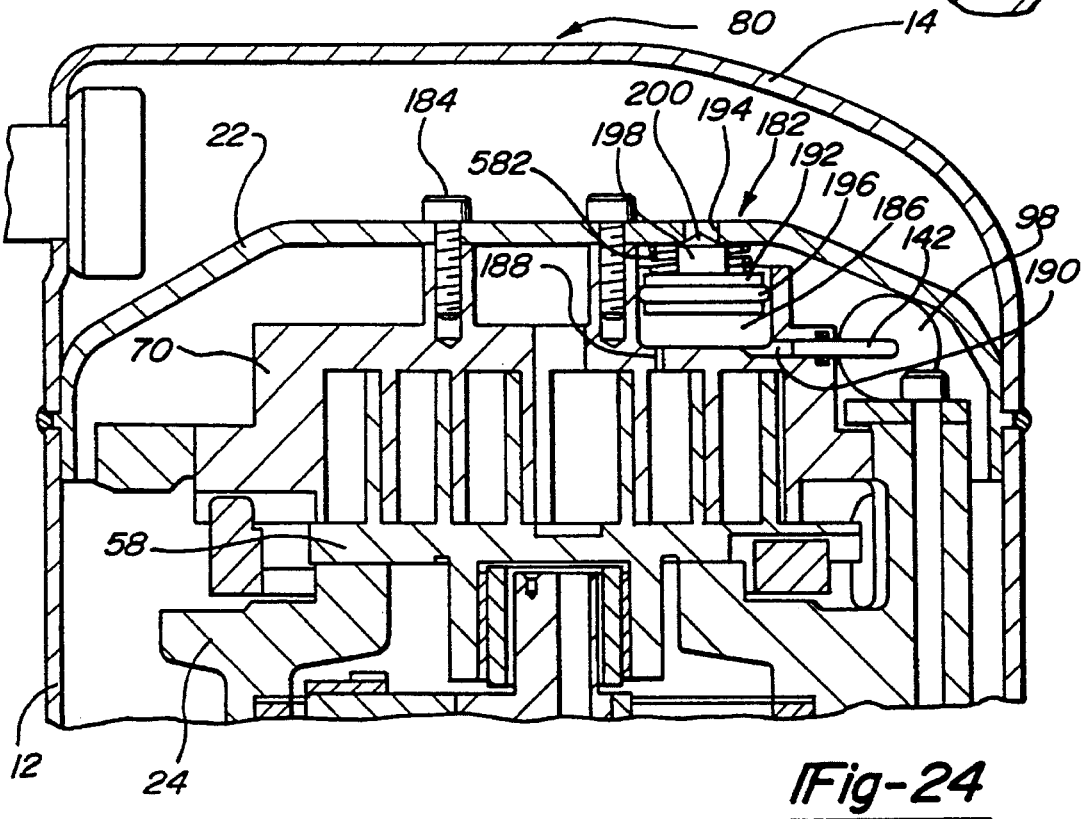
FIG. 24 is a vertical section through the upper portion of a scroll compressor which incorporates another embodiment of the present invention.

FIGS. 23 and 24 each show another embodiment of the present invention which is similar to the embodiment shown in FIGS. 5 and 6 respectively. The embodiments shown in FIGS. 23 and 24, similar to the embodiments shown in FIGS. 5 and 6 include a pressure ratio sensitive valve which directly passes discharge pressure to suction pressure. FIG. 23 shows a compressor 550 having pressure ratio sensitive valve 152 incorporated into orbiting scroll 58. The reference numerals shown in FIG. 23 which are identical to those shown in FIG. 5 depict like or corresponding components in both figures. Biasing means in the form of a coil spring 552 is disposed between valve 152 and orbiting scroll 58 in order to bias valve 152 into an open position such that there is communication between the discharge area and the suction area of compressor 550.

The operation of compressor 550 is similar to compressor 150 shown in FIG. 5 except for the interaction of coil spring 552. At compressor start-up, solenoid 100 is energized and valve 102 is closed to block any fluid flow from passage 140 through passageway 112. Intermediate pressure builds quickly within chamber 132 overcoming the biasing load of coil spring 552. Valve 152 is prevented from seating on the lower surface of chamber 132 by methods known well in the art in order to insure that the fluid pressure within chamber 132 is always acting on the lower surface of valve 152. In this way, compressor 550 makes a normal start-up. The time delay feature for compressor start-up may also be build into solenoid valve 98 for this embodiment if desired. While compressor 550 is in operation valve 152 operates similar to the operation described for FIG. 5. The difference between FIG. 23 and FIG. 5 is that in FIG. 23, the opening and closing of pressure ratio sensitive valve 152 can be controlled by selecting the size of coil spring 552, the size of valve body 160 and the size and diameter of annular ring 162 to control the loading being applied to valve body 160. At compressor shutdown, coil spring 552 helps to control the rate of dumping of intermediate pressure gas to suction pressure which controls the rate of downward movement of valve 152 which in turn controls the rate of discharge gas to suction gas dumping. The various controls including the size of coil spring 552, the size of passageway 140 and/or passageway 122 and the time delay at compressor shut down described above for the embodiment in FIG. 5 and FIG. 6 are also applicable to this embodiment. In addition, the amount of reverse rotation can be further controlled by the size of passageways 156 and 158 the size of coil spring 552 as well as the ratio of surface areas as described above for valve body 160.

FIG. 24 shows a compressor 580 similar to compressor 180 shown in FIG. 6 but with the addition of biasing means in the form of a coil spring 582 for biasing pressure ratio sensitive valve 182 into an open position. When valve 182 is on its open position, the discharge area of compressor 580 is in communication with the suction area.

The operation of the embodiment shown in FIG. 24 is identical to the embodiment shown in FIG. 6 except for the effects of coil spring 582. Intermediate pressure within pocket 186 exerts an upward force on valve body 192 while coil spring 582, discharge pressure and suction pressure exert a downward force on valve body 192. Thus, the opening and closing of pressure ratio sensitive valve 182 can be controlled by selecting the size of coil spring 582, the size of valve body 192 and the size of orifice 194. At compressor shut-down the movement of valve body 192 can be controlled by the size of coil spring 582 as well as controlled by the size of passageway 190 and/or passageway 112. The time delay at compressor shut-down described for the embodiment in FIG. 4 are also applicable to this embodiment. In addition, the amount of reverse rotation can be further controlled by the size of orifice 194 in relationship to the size of valve body 192 as described above.

Figure 25:
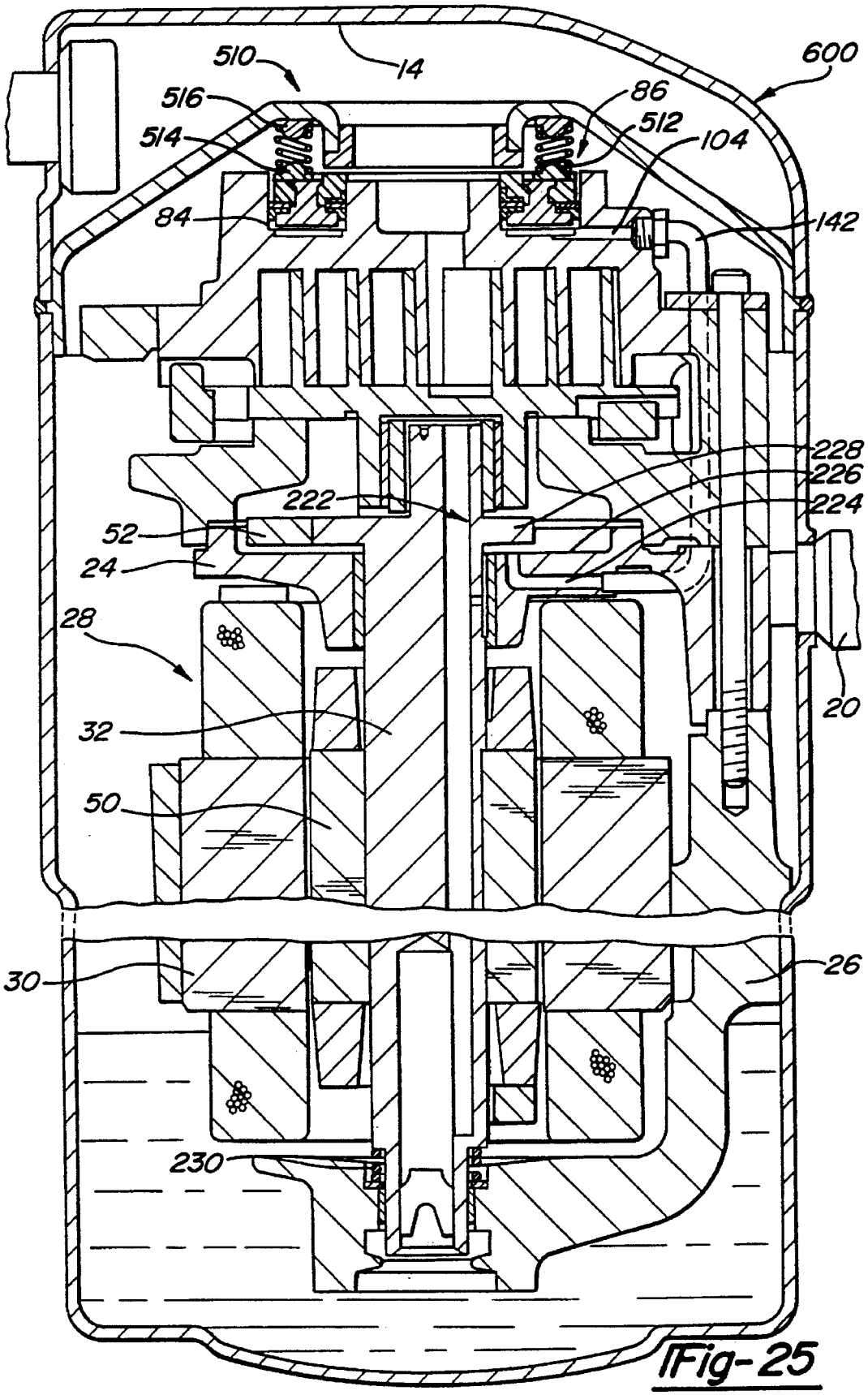
FIG. 25 is a vertical section through the center of a scroll compressor which utilizes the compressor motor as a solenoid valve.

FIG. 25 shows an additional embodiment of the present invention which is similar to the embodiment shown in FIG.

7, but FIG. 25 illustrates a compressor 600 which incorporates biasing means 510. Biasing means 510 comprises the plurality of coil springs 512 and spacer rings 514 and 516. The operation of compressor 600 shown in FIG. 25 is identical to the operation of compressor 220 shown in FIG. 7 except for the effect of biasing means 510.

At compressor start-up, crankshaft 32 is forced downward against the load of biasing spring 230 due to the centering force created by the magnetic field of motor 28 which tends to axially center motor rotor 50 and thus crankshaft 32 within motor stator 30. This downward movement of crankshaft 32 brings into contact sealing flange 228 and upper surface 226 which prohibits flow through passageway 224. Intermediate pressure quickly builds in recess 84 overcoming the biasing load of the plurality of coil springs 512 allowing compressor 600 to make a normal start-up. At compressor shutdown, power to motor 28 is cut off eliminating the magnetic field which tends to center motor rotor 50 within motor stator 30. Crankshaft 32 is once again biased upwards by spring 230 separating sealing flange 228 from upper surface 226 and opening passageway 224 to the suction area of compressor 600. The fluid flow from passageway 104, through tube 142 and through passageway 224 allows fluid flow from the bottom of chamber 84 to the suction area of compressor 600. As the intermediate pressure and suction pressure are equalized, floating seal 86 has a net downward force due to the plurality of coil springs 512 and due to the discharge gas pressure. The net downward force produces a controlled discharge gas to suction gas leak identical to that described for FIG. 20.

The spring biasing of the floating seal as shown in FIGS. 20 and 25 or the spring biasing of a valve member as shown in FIGS. 21 through 24 can also be used with any of the valving systems shown in FIGS. 8 through 14 and/or the fail safe device illustrated in FIGS. 15 through 17

While the above detailed description describes the preferred embodiments of the present invention, it should be understood that the present invention is susceptible to modification, variation and alteration without deviating from the scope and fair meaning of the subjoined claims.

What is claimed is:

1. A scroll machine comprising:

a first scroll member having a first spiral wrap projecting outwardly from an end plate;

a second scroll member having a second spiral wrap projecting outwardly from an end plate, said second spiral wrap intermeshed with said first spiral wrap;

a drive member for causing said scroll members to orbit relative to one another whereby said spiral wraps will create pockets of progressively changing volume between a suction pressure zone and a discharge pressure zone, said scroll machine including a leakage path disposed between two components of said scroll machine, said leakage path extending between said discharge pressure zone and said suction pressure zone, said leakage path being closed due to the influence of a pressurized fluid biasing said two components together;

a valve member for releasing said pressurized fluid to said suction pressure zone of said scroll machine whereby said leakage path between said discharge pressure zone and said suction zone is opened; and biasing means for opening said leakage path due to the influence of said biasing means, said biasing means comprising a plurality of coil springs.

2. The scroll machine according to claim 1 further comprising:

means defining a cavity disposed within one of said scroll members;

means for supplying said pressurized fluid to said cavity; and seal means disposed within said cavity to close said leakage path due to the influence of said pressurized fluid.

3. The scroll machine according to claim 2 wherein said biasing means is disposed between a stationary member of said scroll machine and said seal means.

4. The scroll machine according to claim 2 wherein said seal means floats axially in said cavity between a first position where said seal means isolates fluid in said suction pressure zone from fluid in said discharge pressure zone and a second position wherein fluid in said discharge pressure zone is leaked to said suction pressure zone.

5. The scroll machine according to claim 4 wherein said pressurized fluid in said cavity urges said seal means towards said first position.

6. The scroll machine according to claim 4 wherein said biasing means urges said seal means towards said second position.

7. A scroll machine comprising:

a first scroll member having a first spiral wrap projecting outwardly from an end plate;

a second scroll member having a second spiral wrap projecting outwardly from an end plate, said second spiral wrap intermeshed with said first spiral wrap, one of said scroll members being mounted for limited axial movement with respect to the other scroll member, said one member being biased toward said other scroll member by a pressurized fluid;

a drive member for causing said scroll members to orbit relative to one another whereby said spiral wraps will create pockets of progressively changing volume between a suction pressure zone and a discharge pressure zone, said scroll machine including a leakage path disposed between two components of said scroll machine, said leakage path extending between said discharge pressure zone and said suction pressure zone, said leakage path being closed due to the influence of said pressurized fluid biasing said two components together;

a valve member for releasing said pressurized fluid to said suction pressure zone of said scroll machine whereby said leakage path between said discharge pressure zone and said suction zone is opened; and biasing means for opening said leakage path due to the influence of said biasing means.

8. The scroll machine according to claim 7 wherein said biasing means comprises a plurality of coil springs.

9. The scroll machine according to claim 7 further comprising:

means defining a cavity disposed within one of said scroll member;

means for supplying said pressurized fluid to said cavity; and seal means disposed within said cavity to close said leakage path due to the influence of said pressurized fluid.

10. The scroll machine according to claim 9 wherein said biasing means is disposed between a stationary member of said scroll machine and said seal means.

11. The scroll machine according to claim 10 wherein said biasing means comprises a plurality of coil springs.

12. The scroll machine according to claim 9 wherein said seal means floats axially in said cavity between a first position where said seal means isolates fluid in said suction pressure zone from fluid in said discharge pressure zone and a second position wherein fluid in said discharge pressure zone is leaked to said suction pressure zone.

13. The scroll machine according to claim 12 wherein said pressurized fluid in said cavity urges said seal means towards said first position.

14. The scroll machine according to claim 13 wherein said biasing means urges said seal means towards said second position.

15. A scroll machine comprising:

a first scroll member having a first spiral wrap projecting outwardly from an end plate;

a second scroll member having a second spiral wrap projecting outwardly from an end plate, said second spiral wrap intermeshed with said first spiral wrap;

a drive member for causing said scroll members to orbit relative to one another whereby said spiral wraps will create pockets of progressively changing volume between a suction pressure zone and a discharge pressure zone, said scroll machine including a leakage path disposed between two components of said scroll machine, said leakage path extending between said discharge pressure zone and said suction pressure zone, said leakage path being closed due to the influence of a pressurized fluid biasing said two components together;

a valve member disposed within said suction pressure zone for releasing said pressurized fluid to said suction pressure zone of said scroll machine whereby said leakage path between said discharge pressure zone and said suction zone is opened.

16. The scroll machine according to claim 15 further comprising biasing means for opening said leakage path due to the influence of said biasing means.

17. The scroll machine according to claim 16 wherein said biasing means comprises a plurality of coil springs.

18. The scroll machine according to claim 15 further comprising:

means defining a cavity disposed within one of said scroll member;

means for supplying said pressurized fluid to said cavity; and seal means disposed within said cavity to close said leakage path due to the influence of said pressurized fluid.

* * * * *

UNITED STATES PATENT AND TRADEMARK OFFICE

CERTIFICATE OF CORRECTION

PATENT NO. : 5,607,288

DATED : March 4, 1997

INVENTOR(S) : Frank S. Wallis; Jean-Luc Caillat; Francis M. Simpson; Gary J. Anderson; Donald W. Rode; Norman G. Beck It is certified that error appears in the above-indentified patent and that said Letters Patent is hereby corrected as shown below:

Column 1, line 7, "8/158,754" should be -- 08/158,754 --.

Column 1, line 7, after "1993", delete "," and insert -- . --.

Column 3, line 28, delete "and".

Column 3, line 31, "." should be -- ; --.

Column 3, line 60, after "now" insert "to".

Column 5, line 4, "applicant's" should be "applicants'".

Column 5, line 18, "," should be -- . --.

Column 5, line 23, "applicant's" should be -- applicants' --.

Column 7, line 13, "32" should be -- 132 --.

Column 9, line 36, "160" should be "180".

Column 9, line 48, "166" should be -- 186 --.

Column 9, line 50, "166" should be "186".

UNITED STATES PATENT AND TRADEMARK OFFICE

CERTIFICATE OF CORRECTION

PATENT NO. : 5,607,288

DATED : March 4, 1997

INVENTOR(S) : Frank S. Wallis; Jean-Luc Caillat; Francis M. Simpson; Gary J. Anderson; Donald W. Rode; Norman G. Beck It is certified that error appears in the above-indentified patent and that said Letters Patent is hereby corrected as shown below:

Column 10, line 33, "filed" should be -- field --.

Column 11, line 29, "seat" should be -- seal --.

Column 17, line 58, "51 2" should be -- 512 --.

Column 18, line 20, "build" should be -- built --.

Column 19, line 34, after "17" insert -- . --.

Column 20, line 56, "member" should be -- members --.

Column 21, line 10, "13" should be -- 12 --.

Column 22, line 18, "member" should be -- members --.

Signed and Sealed this

Twenty-eighth Day of October, 1997

*Attest:*

*Attesting Officer*

Bruce Lehman

BRUCE LEHMAN

*Commissioner of Patents and Trademarks*